US006128592A

United States Patent [19]

Miyazaki et al.

[11] Patent Number: 6,128,592

[45] Date of Patent: Oct. 3, 2000

[54] SIGNAL PROCESSING APPARATUS AND METHOD, AND TRANSMISSION MEDIUM AND RECORDING MEDIUM THEREFOR

[75] Inventors: Satoshi Miyazaki, Tokyo; Kyoya Tsutsui, Kanagawa, both of Japan

[73] Assignee: Sony Corporation, Tokyo, Japan

[21] Appl. No.: 09/078,027

[22] Filed: May 13, 1998

[30] Foreign Application Priority Data

May 16, 1997 [JP] Japan ..... 9-126678
Jun. 30, 1997 [JP] Japan ..... 9-174055

[51] Int. Cl.[7] ..... G10L 19/00

[52] U.S. Cl. ..... 704/224; 704/230

[58] Field of Search ..... 704/224, 200, 704/201, 500, 502, 504, 230, 222, 205, 206

[56] References Cited

U.S. PATENT DOCUMENTS

| | | | |
|---|---|---|---|
| 3,349,183 | 10/1967 | Campanella | 179/15.55 |
| 4,535,472 | 8/1985 | Tomcik | 381/31 |
| 4,625,286 | 11/1986 | Papamichalis et al. | 364/513.5 |
| 4,713,776 | 12/1987 | Araseki | 364/513.5 |
| 4,896,362 | 1/1990 | Veldhuis et al. | 381/30 |
| 5,109,417 | 4/1992 | Fielder et al. | 381/36 |
| 5,113,293 | 5/1992 | Endo et al. | 360/32 |
| 5,166,981 | 11/1992 | Iwahashi et al. | 381/36 |
| 5,264,846 | 11/1993 | Oikawa | 341/76 |
| 5,301,205 | 4/1994 | Tsutsui et al. | 375/1 |
| 5,375,189 | 12/1994 | Tsutsui | 395/2.38 |
| 5,438,643 | 8/1995 | Akagiri et al. | 395/2.1 |
| 5,454,011 | 9/1995 | Shimoyoshi | 375/240 |
| 5,617,219 | 4/1997 | Oikawa | 386/111 |
| 5,731,767 | 3/1998 | Tsutsui et al. | 341/50 |
| 5,752,224 | 5/1998 | Tsutsui et al. | 704/225 |
| 5,754,127 | 5/1998 | Tsutsui et al. | 341/54 |
| 5,765,126 | 6/1998 | Tsutsui et al. | 704/206 |
| 5,832,424 | 11/1998 | tsutsui | 704/206 |
| 5,832,426 | 11/1998 | Tsutsui et al. | 704/229 |
| 5,870,703 | 2/1999 | Oikawa et al. | 704/206 |

OTHER PUBLICATIONS

J. Rothweiler, "Polyphase Quadrature Filters—A New Subband Coding Technique," Proceedings of the ICASSP '83, vol. 3 of 3, Apr. 14–16, 1983, pp. 1280–1283.

J. Princen et al., "Subband/Transform Coding Using Filter Bank Designs Based on Time Domain Aliasing Cancellation," Proceedings of the ICASSP, vol. 4, Apr. 6–9, 1987, pp. 2161–2164.

R. Zelinski et al., "Adaptive Transform Coding of Speech Signals," IEEE Transactions on Acoustics, Speech and Signal Processing, vol. ASSP–25, No. 4, Aug. 1977, pp. 299–309.

M. Krasner, "The Critical Band Coder—Digital Encoding of Speech Signals Based on the Perceptual Requirements of the Auditory System," IEEE Apr. 1980, vol. 1 of 3, pp. 327–331.

*Primary Examiner*—Richemond Dorvil
*Attorney, Agent, or Firm*—Limbach & Limbach L.L.P.

[57] ABSTRACT

A signal processing apparatus and method decodes codes generated by encoding decomposed frequency components, and combines frequency components obtained in the decoding to form a waveform signal. The apparatus and method further monitors a processing condition in the decoding, and controls a processed band of the waveform signal, formed in the combining, in accordance with the monitoring result obtained in the monitoring.

35 Claims, 20 Drawing Sheets

FIG. 15

| |
|---|
| NUMBER OF PIECES OF QUANTIZATION-PRECISION INFORMATION (9) |
| QUANTIZATION-PRECISION INFORMATION 1 |
| QUANTIZATION-PRECISION INFORMATION 2 |
| ⋮ |
| QUANTIZATION-PRECISION INFORMATION 8 |
| QUANTIZATION-PRECISION INFORMATION 9 |
| NORMALIZATION-COEFFICIENT INFORMATION 1 |
| NORMALIZATION-COEFFICIENT INFORMATION 2 |
| ⋮ |
| NORMALIZATION-COEFFICIENT INFORMATION 8 |
| NORMALIZATION-COEFFICIENT INFORMATION 9 |
| SPECTRAL COEFFICIENT 1 |
| SPECTRAL COEFFICIENT 2 |
| ⋮ |
| SPECTRAL COEFFICIENT 64 |

FIG. 17

| |
|---|
| NUMBER OF PIECES OF QUANTIZATION-PRECISION INFORMATION (4) |
| QUANTIZATION-PRECISION INFORMATION 1 |
| QUANTIZATION-PRECISION INFORMATION 2 |
| ⋮ |
| QUANTIZATION-PRECISION INFORMATION 4 |
| NORMALIZATION-COEFFICIENT INFORMATION 1 |
| NORMALIZATION-COEFFICIENT INFORMATION 2 |
| ⋮ |
| NORMALIZATION-COEFFICIENT INFORMATION 4 |
| SPECTRAL COEFFICIENT 1 |
| SPECTRAL COEFFICIENT 2 |
| ⋮ |
| SPECTRAL COEFFICIENT 16 |

SIGNAL PROCESSING APPARATUS AND METHOD, AND TRANSMISSION MEDIUM AND RECORDING MEDIUM THEREFOR

BACKGROUND OF THE INVENTION

1. Field of the Invention

The present invention relates to signal processing apparatuses and methods, and transmission media and recording media, and in particular to, a signal processing apparatus and method in which, with so-called "highly efficient encoding" used to divide a band into a plurality of bands, encoded digital data are treated as an input signal, and in a decoding phase the divided bands are combined to form one before it is output. The present invention also relates to a transmission medium and a recording medium, both used in the signal processing apparatus and method.

2. Description of the Related Art

There are various techniques for performing the highly efficient encoding of an audio or sound signal. For example, they include subband coding (SBC) as a deblocked frequency-band dividing which divides a time-domain sound signal into a plurality of frequency band signals using a digital filter without forming blocks of the sound signal, and blocked frequency-band dividing, namely, so-called "transform encoding" in which the (spectral) transform of a time-domain signal into frequency-axial signals is performed to generate a plurality of divided frequency bands and each frequency band is encoded. In addition, a highly efficient encoding technique, as a combination of the above-described subband coding and transform encoding, has been proposed. In this technique, for example, the above-described subband coding is used to divide a band, and the spectral transform of each band signal is performed to form frequency-axial signals. Each spectral-transformed band is encoded.

The above-described digital filter is, for example, a polyphase quadrature filter (PQF). An equal bandwidth filter-dividing technique is described in ICASSP 83, BOSTON, Polyphase Quadrature filters—A New Subband Coding Technique, Joseph H. Rothwiler.

The above-described spectral transform is, for example, a type of spectral transform in which an input sound signal is converted into blocks in units of predetermined time (frames), and the discrete Fourier transform (DFT), discrete cosine transform (DCT), modified discrete cosine transform (MDCT), etc. of each block is performed to transform a time axis into a frequency axis. MDCT is described in ICASSP 1987, Subband/Transform Coding, Using Filter Bank Designs Based on Time Domain Aiasing Cancellation, J. P. Princen, A. B. Bradley Univ. of Survey Royal Melbourne Inst. of Tech.

By quantizing signals divided so as to correspond to bands by a digital filter and spectral transform, bands in which quantization noise is generated can be controlled, and using characteristics such as effects of masking enables encoding which is highly efficient for the sense of hearing. In addition, for example, before quantization is performed, by performing normalization using the maximum absolute value of signal components in each band, more highly efficient encoding can be performed.

Concerning a frequency dividing width for quantizing the frequency components of each divided frequency band, band division can be performed considering human auditory characteristics. In other words, there may be a case in which a sound signal is divided into a plurality of bands (e.g., 25 bands) by using a bandwidth in which the bandwidth widens as the band rises. At this time, predetermined bit provision for each band, or adaptive bit allocation is performed.

For example, when coefficient data obtained from MDCT are encoded by bit allocation, MDCT coefficient data for each band, obtained by performing the MDCT of each band, are encoded using the number of adaptively allocated bits. The following two techniques are known as bit allocation.

A technique for bit allocation based on the magnitude of a signal for each band is disclosed in IEEE Transactions of Acoustics, Speech, and Signal Processing, vol. ASSP-25, No. 4, August 1977. According to this technique, quantization noise is flat and noise energy is minimized. However, since auditory effects of masking are not used, a sense of a listener who actually hears noise is not optimum.

A technique for performing fixed bit allocation by using auditory masking to obtain a signal-to-noise ratio for each band is disclosed in ICASSP 1980, The critical band coder,—digital encoding of the perceptual requirements of the auditory system M. A. Kransner MIT. According to this technique, bit allocation is fixed even when measurement of characteristics is performed using a sine-wave input. Thus, the characteristic values are not so preferable.

In order to solve these problems, a highly efficient encoder has been proposed. According to the highly efficient encoder, all bits usable for bit allocation are divided for use into bits for predetermined fixed bit allocation pattern for each small block, and bits for bit allocation dependent on the magnitude of a signal for each block. By setting the divisional ratio to be dependent on a signal related to an input signal, the divisional ratio of the fixed bit allocation pattern is increased in proportion to the smoothness of the signal spectrum.

According to the highly efficient encoder, in the case where energy concentrates on a certain spectral component as in a sine-wave input, the allocation of many bits to a block including the spectral component can remarkably improve the whole signal-to-noise ratio. In general, human auditory sense is extremely sensitive to signals having a steep spectral component. Therefore, the use of this encoding technique to improve the signal-to-noise ratio is effective not only in simply improving measured values but also in improving auditory sound quality.

In addition to this technique, many other techniques for bit allocation have been proposed. According to these techniques, an auditory model is detailed, and improving the encoder ability enables highly efficient encoding in the sense of hearing.

To realize the decoding of highly-efficient-encoded data, it is necessary to carry out, a considerable number of operations compared with the case where sampled values of a signal are simply used. In particular, when a signal to be treated includes a high-band component and is distributed in wide bands, the number of spectral components to be treated increases, and a sampling frequency increases. Thus, the number of necessary operations per unit time is increased. Accordingly, for real-time reproduction in which, while a predetermined amount of sound signals is being decoded, the decoded waveform signals are reproduced, a processor for this decoding needs to have an extremely high arithmetic ability. If a processor having a low arithmetic ability is used, decoding cannot follow real-time reproduction, which cannot maintain the continuity of the reproduced sound.

In addition, in the case where the above-described decoding is performed in a multitasking personal computer or the like, a processor takes time to process tasks besides the decoding, and time for the processor to perform the decoding per unit time is reduced to hindering the real-time reproduction, similar to the above described case.

SUMMARY OF THE INVENTION

Accordingly, It is an object of the present invention to provide a signal processing apparatus and method in which the arithmetic ability of a processor to be used is measured by a decoding program, and when the arithmetic ability Is low, the processing is simplified by performing the decoding of necessary bands to enable the real-time reproduction of a signal.

It is another object of the present invention to provide a signal processing apparatus and method in which, when real-time reproduction cannot be performed since a plurality of simultaneously executed tasks increase the total processing amount of a processor to be not less than a certain extent, compared with the case of single real-time-reproduction processing, the real-time reproduction of a signal can be performed by simply switching the processing to the decoding of only a necessary band in accordance with the total processing amount, while always monitoring the total processing amount.

In addition, it is a further object of the present invention to provide a transmission medium used for the above signal processing apparatuses and methods.

To these ends, according to a first aspect of the present invention, the foregoing objects have been achieved through provision of a signal processing apparatus comprising: decoding means for decoding codes generated by encoding decomposed frequency components; combining means for combining frequency components obtained by said decoding means to form a waveform signal; monitor means for monitoring a processing condition of said decoding means; and control means for controlling a processed band of the waveform signal formed by said combining means in accordance with the monitoring result by said monitor means.

According to a second aspect of the present invention, the foregoing objects have been achieved through provision of a signal processing method comprising the steps of:

decoding codes generated by encoding decomposed frequency components; combining frequency components obtained in the decoding step to form a waveform signal; monitoring a processing condition in the decoding step; and controlling a processed band of the waveform signal, formed in the combining step, in accordance with the monitoring result obtained in the monitoring step.

According to another first aspect of the present invention, the foregoing objects have been achieved through provision of a signal processing apparatus comprising: decomposing means for decomposing an input signal into frequency-component signals; encoding means for encoding the frequency-component signals decomposed by said decomposing means; monitor means for monitoring a processing condition by said decomposing means; and control means for controlling a processed band of the frequency decomposed by said decomposing means in accordance with the monitoring result by said monitor means.

According to another second aspect of the present invention, the foregoing objects have been achieved through provision of a signal processing method comprising the steps of: decomposing an input signal into frequency-component signals; encoding the frequency-component signals formed by the decomposing step; monitoring a processing condition by the encoding step; and controlling a processed band of the frequency decomposed by the decomposing step in accordance with the monitoring result by the monitoring step.

According to a third aspect of the present invention, the foregoing objects have been achieved through provision of a transmission medium for transmitting a program comprising the steps of: decoding codes generated by encoding decomposed frequency components; combining frequency components obtained in the decoding step to form a waveform signal; monitoring a processing condition in the decoding step; and controlling a processed band of the waveform signal, formed in the combining step, in accordance with the monitoring result obtained in the monitoring step.

According to another third aspect of the present invention, the foregoing objects have been achieved through provision of a transmission medium for transmitting a program comprising the steps of: decomposing an input signal into frequency-component signals; encoding the frequency-component signals decomposed by the decomposing step; monitoring a processing condition by the decomposing step; and controlling a processed band of the frequency decomposed by the decomposing step in accordance with the monitoring result by the monitoring step.

According to a further third aspect of the present invention, the foregoing objects have been achieved through provision of a recording medium for holding codes generated by implementing signal processing, said processing comprising the steps of: decomposing an input signal into frequency-component signals; encoding the frequency-component signals formed by the decomposing step; monitoring a processing condition by the encoding step; controlling a processed band of the frequency decomposed by the decomposing step in accordance with the monitoring result by the monitoring step; and recording the encoded frequency-component signals on said recording medium.

According to the present invention, a processing condition of the decoding of frequency components is monitored, and in accordance with the monitoring result, the number of processed bands combined into the waveform signal is controlled, whereby real-time reproduction can be continuously performed without interruption.

In addition, according to the present invention, an input signal is decomposed into frequency-component signals before the signals are encoded, and a processed band of the frequency decomposed is controlled in accordance with a result of monitoring an encoding condition, whereby real-time reproduction can be continuously performed without interruption.

BRIEF DESCRIPTION OF THE DRAWINGS

FIG. 15 is a chart Illustrating the output of the code-string generating circuit 3 shown in FIG. 14.

FIG. 17 is a chart illustrating the output of the code-string generating circuit 3 shown in FIG. 14.

DESCRIPTION OF THE PREFERRED EMBODIMENTS

Preferred embodiments of the present invention will be described with reference to the attached drawings.

Figure 1:
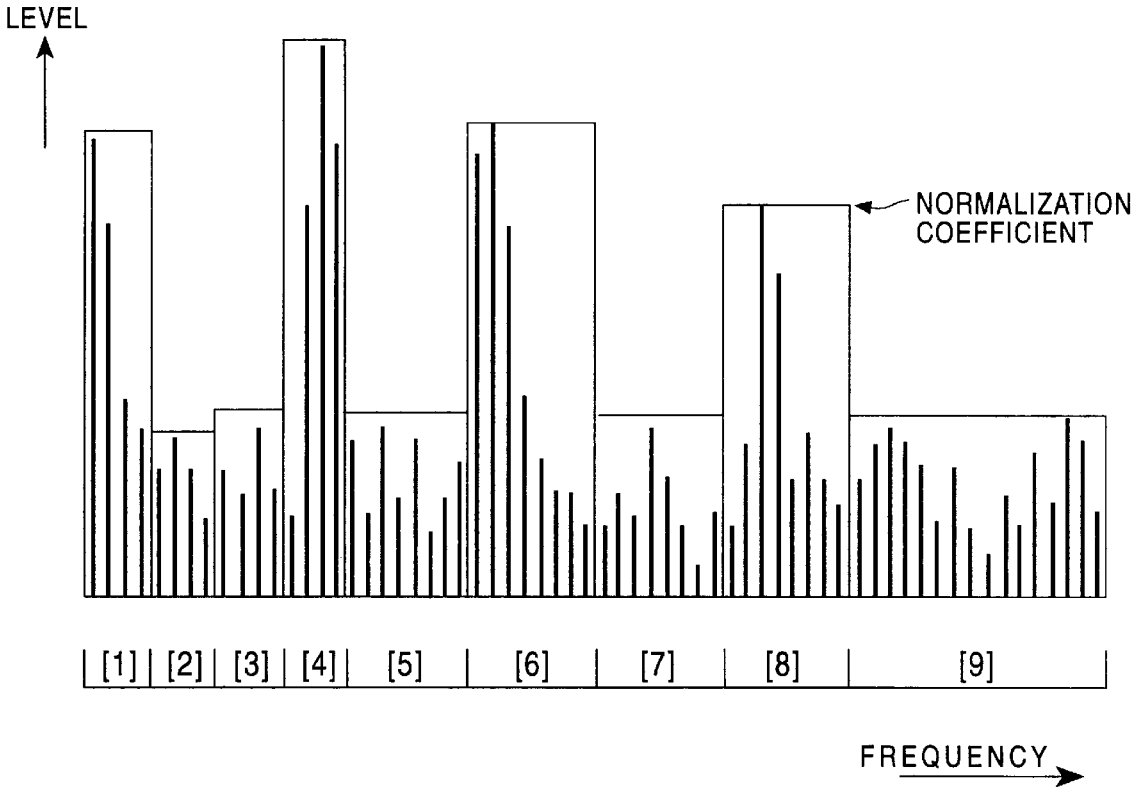
FIG. 1 is a diagram illustrating a method for performing the highly efficient encoding of a sound signal.

According to the present invention, an input signal is decomposed by spectral transform such as MDCT into spectral components as shown in FIG. 1. Spectral coefficients are grouped to correspond to predetermined bands (Bands [1] to [9] in FIG. 1), and normalized. Here, normalization means that each spectral component is divided by a normalization coefficient determined by the maximum absolute value of the spectral coefficient in each band.

Next, the spectral coefficients normalized for the respective bands are requantized with the given number of bits. The number of bits may be constant regardless of an input signal, or may be found depending on an input signal while considering masking etc. By performing normalization, the spectral coefficient of a band consisting of only low-level frequency components can efficiently be requantized with a smaller number of bits. Reducing the number of bits for requantization can compress the original signal.

Figure 2:
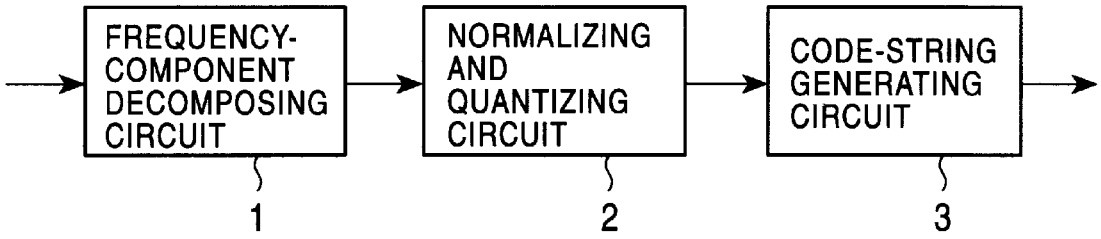
FIG. 2 is a block diagram showing a highly efficient encoder.

FIG. 2 shows a block diagram of a highly efficient encoder for encoding a sound signal. A sound signal input into the encoder is decomposed by a frequency-component decomposing circuit 1 into frequency-component signals, as shown in FIG. 1. The frequency-component signals are normalized and requantized for respective bands by a normalizing and quantizing circuit 2 as described in FIG. 1. After that, a code-string generating circuit 3 transforms quantization-precision information, normalization-coefficient information, and normalized-and-quantized-frequency-component information (spectral coefficients) into code strings.

Figure 3:
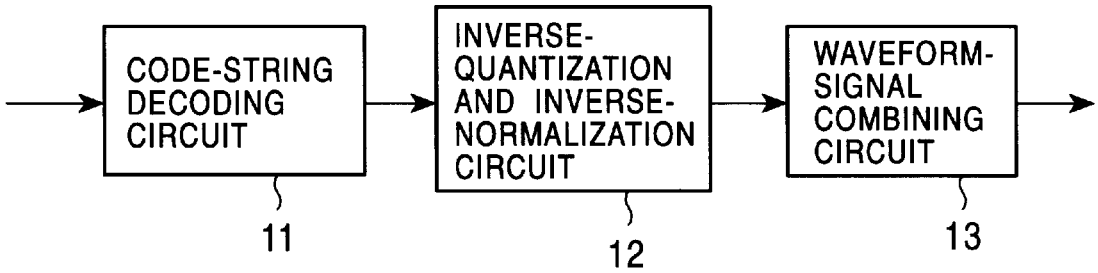
FIG. 3 is a block diagram showing a decoder.

FIG. 3 shows a block diagram of a decoder according to an embodiment of the present invention, which corresponds to the encoder shown in FIG. 2. Input code strings are separated by a code-string decoding circuit 11 into quantization-precision information, normalization-coefficient information, and normalized- and-quantized-frequency-component information (spectral coefficients). The separated pieces of information are sent to an inverse-quantization and inverse-normalization circuit 12, in which they are inverse-quantized and inverse-normalized to generate a frequency-component signal. The generated frequency-component signal is sent to a waveform signal combining circuit 13, and transformed to a waveform signal before it is output.

A circuit for spectral transform such as DFT, DCT or MDCT, or a band dividing filter, may be used as the frequency-component decomposing circuit 1, which decomposes a time-domain signal into frequency components. In addition, a combination of a band dividing filter and spectral transform circuits, as shown in FIG. 4, may be used.

Figure 4:
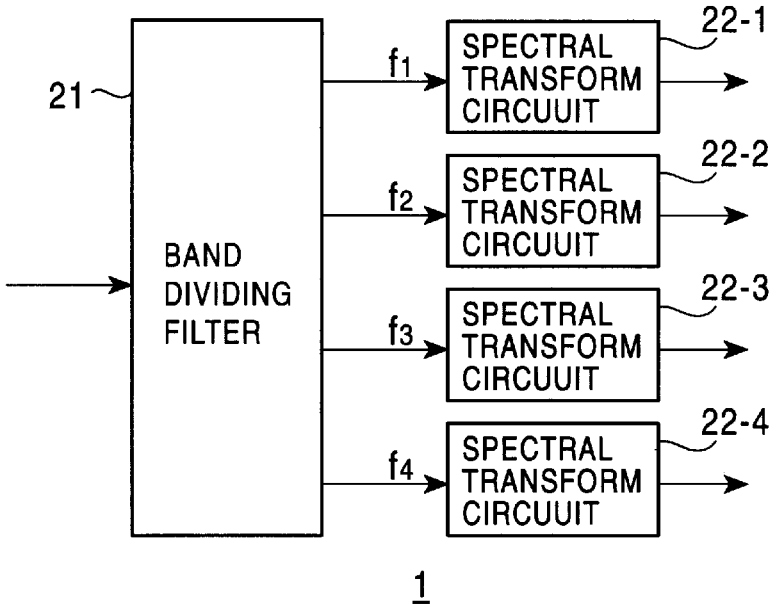
FIG. 4 is a block diagram showing the frequency-component decomposing circuit 1 shown in FIG. 2.

According to the embodiment shown in FIG. 4, an input waveform signal is divided by a band dividing filter 21 into four frequency bands $f_1$ to $f_4$. $f_1$ to $f_4$ represent the lowest to highest-band signals. Each signal has a quarter of the bandwidth of that of the waveform signal input to the band dividing filter 21, and the sampling rate of each signal is a quarter of that of the input waveform signal. Accordingly, spectral transform circuits 22-1 to 22-4, which perform the spectral transform of these signals, can actually obtain an identical degree of frequency decomposition by using a quarter of a transform length with which they directly perform the spectral transform of the input signal.

Figure 5:
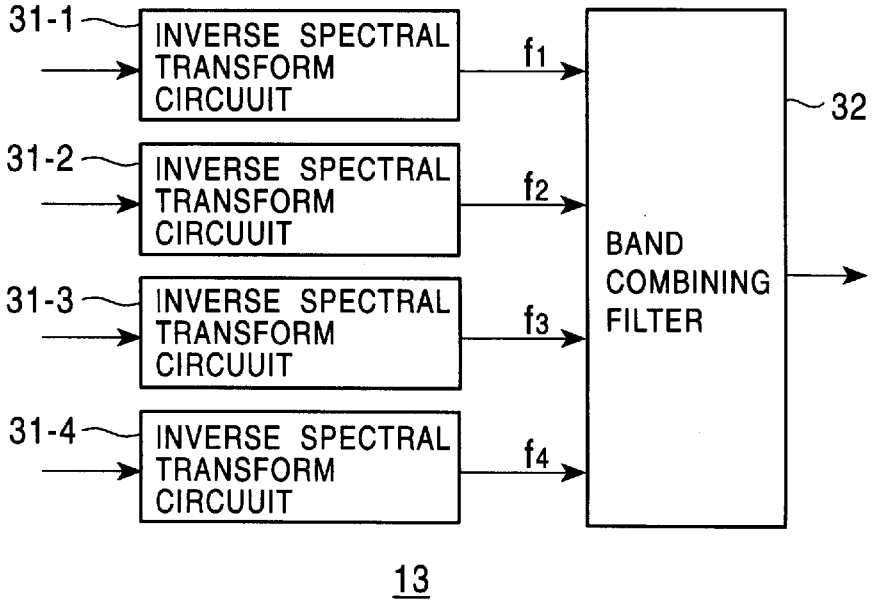
FIG. 5 is a block diagram showing the waveform-signal combining circuit 13 shown in FIG. 3.

FIG. 5 shows an embodiment of a waveform-signal combining circuit 13 corresponding to the frequency-component decomposing circuit 1. Four inputs to inverse spectral transform circuits 31-1 to 31-4 in the waveform-signal component circuit 13 correspond to the outputs of the spectral transform circuits 22-1 to 22-4. The inverse spectral transform circuits 31-1 to 31-4 perform the inverse spectral transform of the input signals, and output the transformed signals. A sampling rate for the outputs of the inverse spectral transform circuits 31-1 to 31-4 is identical to that for the inputs to the spectral transform circuits 22-1 to 22-4. These band signals are combined by a band combining filter 32 to reproduce a waveform signal.

Figure 6:
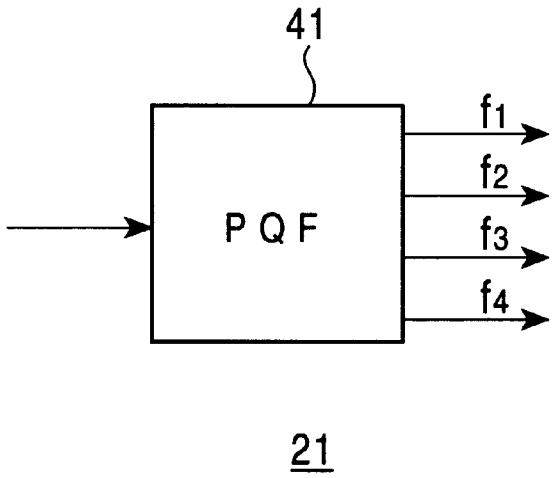
FIG. 6 is a block diagram showing the band-dividing filter 21 shown in FIG. 4.
Figure 7:
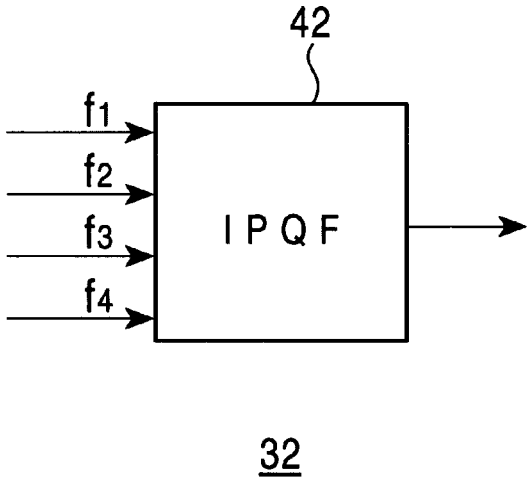
FIG. 7 is a block diagram showing the band-combining filter 32 shown in FIG. 5.

FIGS. 6 and 7 show the band dividing filter 21 shown in FIG. 4 and the band combining filter 32 shown in FIG. 5, respectively. The PQF 41 in FIG. 6 (as the band dividing filter 21) divides an input signal into the following four signals: a high-band signal $f_4$, a middle-high-band signal $f_3$, a middle-low-band signal $f_2$, and a low-band signal $f_1$. The IPQF 42 in FIG. 7 (as the band combining filter 32) combines inputs as the high-band signal $f_4$, the middle-high-band signal $f_3$, the middle-low-band signal $f_2$ and the low-band signal $f_1$, and outputs the combined signal. In this manner, by using the PQF 41 and the IPQF 42 as the band dividing filter 21 and the band combining filter 32, respectively, the influence of aliasing generated by lowering the sampling rate after dividing the band can be cancelled.

Next, the case where a sound signal encoded by using the above-described encoder and decoded to be reproduced by the above-described decoder will be discussed. In many sound signals, important signal components concentrate in a certain band, particularly a low band. Reproduction of higher signal components improves sound quality to provide a sound signal with more presence. However, for uses of reproduced sound in cases where a spoken human voice is listened to and where background music is played, the reproduced sound is not required to have a high quality. Accordingly, in many cases, it is sufficient to reproduce only a low-band signal.

The above-described decoder needs a considerable amount of processing in order to decode and reproduce a wide-band sound signal, compared with the case where it directly reproduces a sample of the original waveform signal. Therefore, in the case where a less powerful processor is used for decoding when real-time reproduction is performed in which decoded data are instantly reproduced while decoding a signal, and in the case where a plurality of tasks are simultaneously executed while using a personal computer etc. to execute software decoding, the decoding cannot follow the reproduction. Accordingly, a method described below is used to always monitor whether or not a processor can decode sound signals in all bands. If the method has determined that the speed of a processor is low, or that sound signals in all bands can hardly be reproduced due to a large load on the processor since a plurality of tasks are simultaneously executing the real-time reproduction of sound is continued without a break by simply switching the processing to the decoding of only a low-band signal.

A method for enabling real-time reproduction in which, while performing decoding, the decoded data are reproduced whenever a predetermined amount is decoded will be initially described below.

Figure 8:
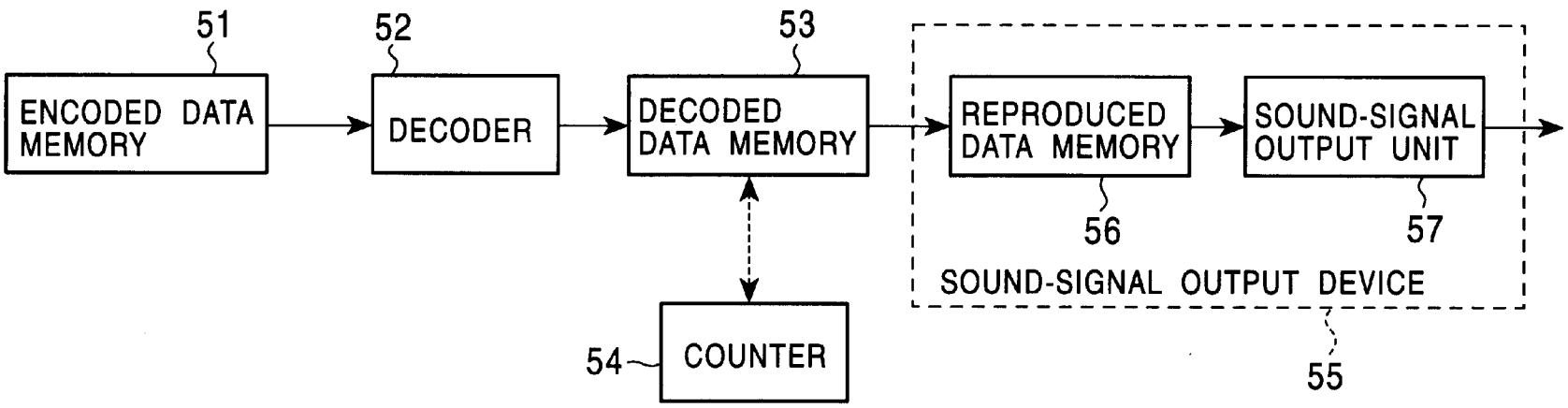
FIG. 8 is a block diagram showing a real-time reproduction system according to an embodiment of the present invention.

FIG. 8 shows a block diagram of a real-time reproduction system according to this embodiment. Encoded data held in an encoded data memory 51 are data encoded by the above-described highly efficient encoder. The encoded data memory 51 may be a storage medium such as a hard disc, a floppy disc, a compact-disc read-only memory, or a random-access memory (RAM) built into a personal computer. When the encoded data memory 51 is a RAM, the operation of writing encoded data in the RAM is added as a pre-step to the real-time reproduction system shown in FIG. 8.

A decoder 52 decodes encoded data extracted from the encoded data memory 51. The decoder 52 is formed such that the code-string decoding circuit 11, the inverse-quantization and inverse-normalization circuit 12 and the waveform-signal combining circuit 13 shown in FIG. 3 are grouped to form one unit. A predetermined amount of the encoded data is extracted by the decoder 52. However, when the data stored in the encoded data memory 51 is not more than the predetermined amount, all the data are extracted at once.

The data input and decoded in the decoder 52 are successively supplied to and held in a decoded data holder 53. Whenever the decoded data are held, the amount of data is counted by a counter 54. When the decoded data holder 53 is full with the decoded data, all the data held in the decoded data holder 53 are sent to a reproduced data memory 56 in a sound-signal output device 55. At the same time, the value of the counter 54 is initialized to zero.

For executing real-time reproduction, the decoded data are frequently written to or read from the decoded data holder 53. Accordingly, a semiconductor RAM is normally used as the decoded data holder 53 as that the writing or reading can rapidly be performed. However, a medium like a hard disc may be used if the decoded data can be written to or read from It at sufficiently high speed. The reproduced data memory 56 Is part of a RAM with fixed addresses in the sound-signal output device 55.

A sound-signal output unit 57 includes a digital-to-analog (D/A) converter, an amplifier, and a speaker, for converting a digital signal to an analog sound signal and outputting it. The sound-signal output unit 57 reads a digital sound signal from the reproduced data memory 56 and outputs a sound signal from the speaker.

By repeatedly performing the above-described steps until all the encoded data in the encoded data memory 51 are decoded and completely reproduced, real-time decoding reproduction is realized.

In the case that the processor for decoding has low processing capacity as described above or that the simultaneous execution of a plurality of tasks reduces the time available for the processor's decoding, the processing of the decoder 52 delays the storing of the decoded data to the decoded data holder 53. This delays the data transfer to the reproduced data memory 56, and the sound-signal output unit 57 has no data to be reproduced, which interrupts the reproduced sound.

Figure 9:
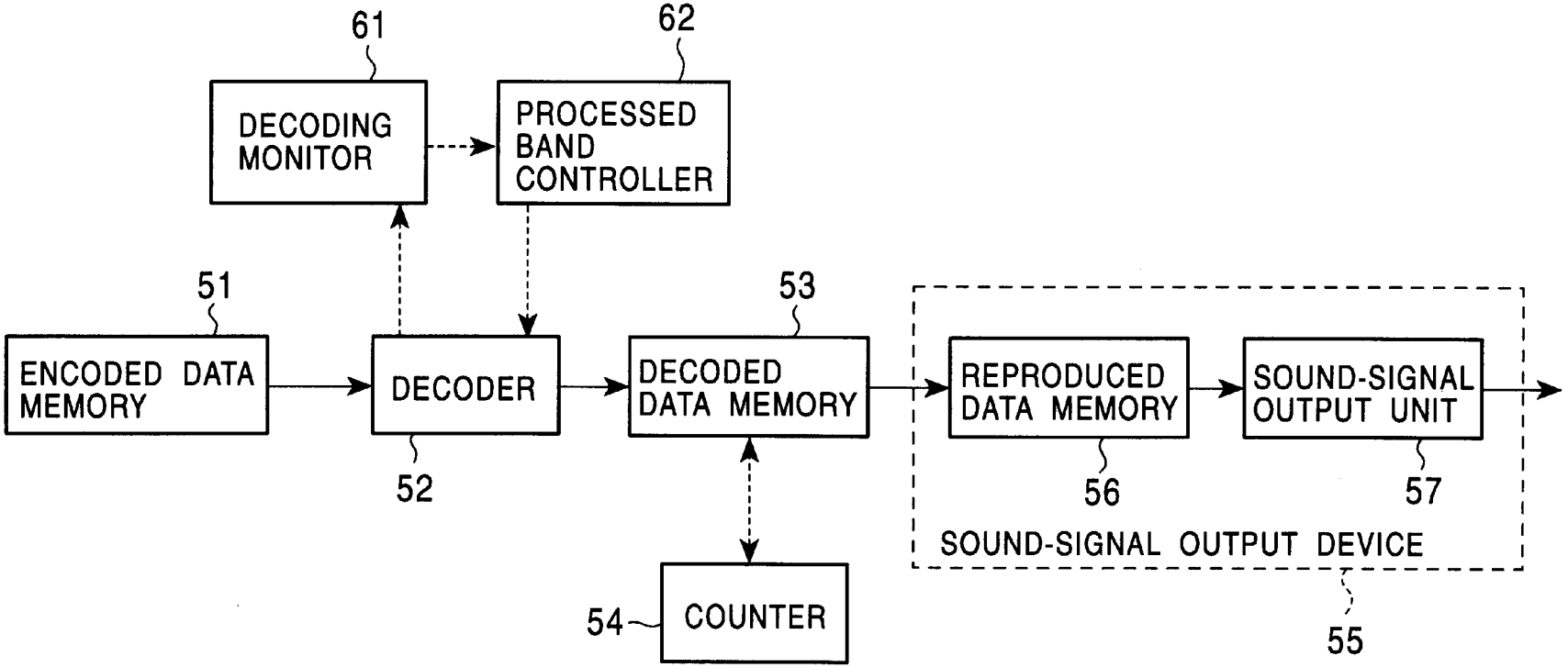
FIG. 9 is a block diagram showing a real-time reproduction system including a decoder according to an embodiment of the present invention.

Therefore, according to the present invention, as shown in FIG. 9, a decoding monitor 61 and a processed band controller 62 are added to the decoder 52 shown in FIG. 8. The structure shown in FIG. 9, excluding the decoding monitor 61 and the processed band controller 62, is identical to that shown in FIG. 8. The decoding monitor 61 monitors the condition of decoding, using, for example, the following method.

The decoding monitor 61 measures the time from a point at which new encoded data are input from the encoded data memory 51 to a point at which the decoding of the encoded data ends and the decoded data are written to the decoding data holder 53. Data for regular monitoring, such as the time measured by the decoding monitor 61, used to determine whether or not real-time reproduction can be continued, are supplied from the decoder 52 to the decoding monitor 61. The decoder 52 acquires the encoded data in units of a predetermined amount. Thus, after the data for one acquisition is decoded, the duration of a sound signal to be reproduced from the decoded data is determined in a single step.

For example, if adaptive transform acoustic coding (ATRAC) for minidiscs is used, 212 bytes of encoded data are acquired from the encoded data memory 51 to the decoder 52 for one acquisition. The 212 bytes of encoded data are decoded by the decoder 52, whereby the encoded data are converted to a 1 channel sound signal for 11.6 milliseconds.

By measuring the time from the start of decoding the encoded data to the end of decoding, the time necessary for decoding at a particular time and environment can be found. The time necessary for decoding changes depending on the processing capacity of the processor, the number of tasks simultaneously executed, and the load (degree of occupation of the CPU) of the tasks. Conversely, the reproduction time of the decoded data as a sound signal is known beforehand. Accordingly, in the time for reproducing the sound signal, the time peri od for decoding can be found. The time period for decoding is hereinafter referred to as the "reproduction-time part".

If the reproduction-time part is more than 100% of the reproduction time, decoding needs more time than sound-signal reproduction. This means that real-time reproduction is impossible.

In addition, when the reproduction-time part is close to 100% even if it is less than 100%, the time for decoding and the reproduction time are almost the same. In this case, when factors increasing the load of the processor are additionally generated, such as interruption from an operating system (OS) and the execution of another task, the continuation of real-time reproduction is impossible.

Conversely, when the reproduction-time part is sufficiently smaller than 100% of the reproduction time, real-time reproduction is realized without difficulty.

Accordingly, if the decoding monitor 61 has determined that the real-time reproduction cannot be continued because the above-described factors are generated and the decoding-time part is close to 100% of the reproduction time, it outputs to the processed band controller 62 a request for changing a processed band. The processed band controller 62 simplifies the decoding by limiting the decoding in all bands to only a low band. By reducing the load on the processor in such a manner, the time for decoding Is shortened.

For example, 50% of the reproduction time is assumed to be the time for decoding. If the time for decoding Is not more than 50% of the reproduction time, the load of decoding on the processor is small, and the decoding is per formed in all the bands. Conversely, if the time for decoding is more than 50% of the reproduction time, it is determined that the processor has insufficient ability for performing the decoding in all the bands without difficulty. In this case, by performing the decoding in only the lowest band, the decoding is simplified. By simplifying the decoding, although the sound quality deteriorates, the real-time reproduction can be continued without a break, even if the decoding in all the bands is impossible.

The time to be measured is not limited to the above-described example. For example, it is possible to start measurement at the same time when the value of the counter 54 is zero and to end the measurement when the decoded data holder 53 is full of decoded data.

The value 50% is shown as an example, but another value may be set depending on the stability of the decoding in the real-time reproduction.

As described above, when decoding cannot sufficiently be performed, the decoding is limited to only the lowest band. In addition, a technique may be used in which band limitation is performed in a plurality of steps and the processed band is gradually narrowed in the plurality of steps in accordance with the magnitude of the load on the processor. This technique will be described below.

Figure 10:
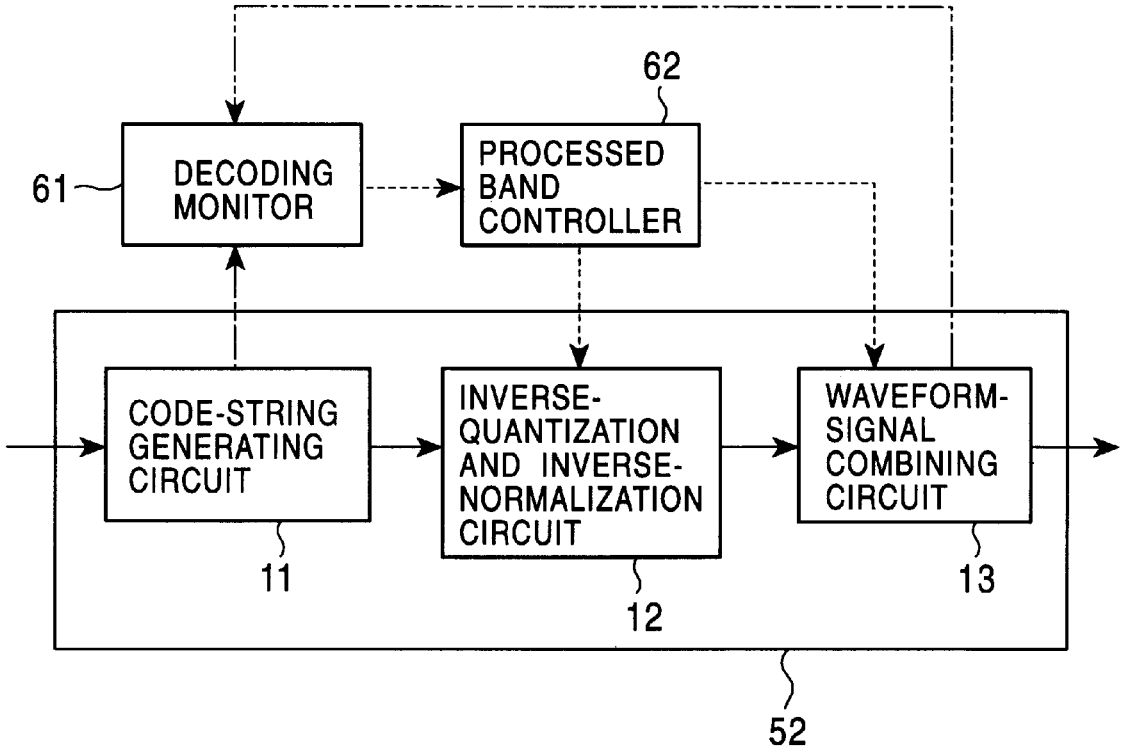
FIG. 10 is block diagram showing the details of the decoder shown in FIG. 9.

FIG. 10 shows the decoder 52, the decoding monitor 61 and the processed band controller 62, as shown in FIG. 9, and also shows the case where the decoder 52 consists of the code-string decoding circuit 11, the inverse-quantization and inverse-normalization circuit 12 and the waveform-signal combining circuit 13, as shown in FIG. 3.

The code-string decoding circuit 11 receives as an input signal, data encoded in the above-described encoding method, and sends information for restoring normalized and quantized spectral coefficients to the inverse-quantization and inverse-normalization circuit 12. The decoding monitor 61 monitors the condition of the decoding by measuring the time for decoding a predetermined amount of code strings. For this purpose, monitoring data are supplied from the code-string decoding circuit 11 and the waveform-signal combining circuit 13 to the decoding monitor 61. The decoding monitor 61 determines the possibility of real-time reproduction from the monitoring data in the above-described manner. If the decoding monitor 61 has determined that the decoding needs to be simplified, it sends a request for simplifying the decoding to the processed band controller 62. In accordance with this request, the processed band controller 62 controls the inverse-quantization and inverse-normalization circuit 12 and the waveform-signal combining circuit 13 to simplify the decoding.

The processed band controller 62 calculates a band to be processed based on the request from the decoding monitor 61, and controls the inverse-quantization and inverse-normalization circuit 12 and the waveform-signal combining circuit 13 to process only the necessary band. For example, the inverse spectral transform circuits 31-1 to 31-4 shown in FIG. 5 are used in accordance with the magnitude of the load on the processor. When the load is large, three inverse spectral transform circuits 31-2 to 31-4 are omitted, and when the load is not so large but real-time reproduction cannot sufficiently be performed, only two inverse spectral transform circuits 31-1 and 31-2 are used, or only the inverse spectral transform circuit 31-1 is used.

Figure 11:
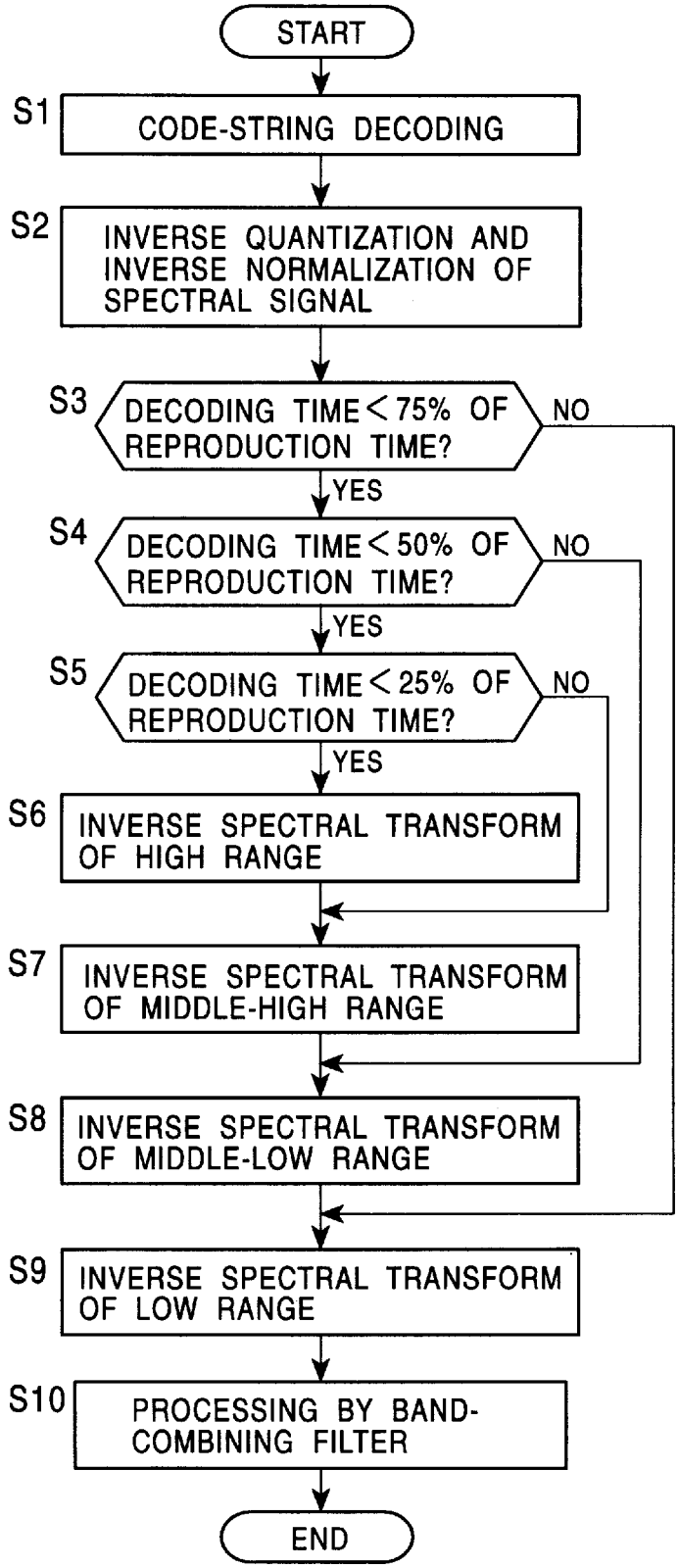
FIG. 11 is a flowchart illustrating a process for decoding according to the present invention.

For example, when the decoding-time part is 75% of the reproduction time, the real-time reproduction cannot sufficiently be performed. Accordingly, only the low band is decoded. When the decoding-time part is 50% to 75% of the reproduction time, the real-time reproduction can to some extent sufficiently be performed. Accordingly, the low band and the middle-low band are decoded. When the decoding-time part is 25% to 50% of the reproduction time, the real-time reproduction can more sufficiently be performed. Accordingly, the low band, the middle-low band, and the middle-high band are decoded. When the decoding-time part is less than 25% of the reproduction time, the processing capacity of the processor is sufficient to decode all the bands. The flowchart of this process is shown in FIG. 11.

Initially, in step S1, code strings are decoded by the code-string decoding circuit 11. In step S2, the inverse-quantization and inverse-normalization circuit 12 is used to perform the inverse quantization and inverse-normalization of a spectral signal output from the code-string decoding circuit 11.

In steps S3 to S5, the decoding monitor 61 monitors outputs from the code-string decoding circuit 11 and the waveform-signal combining circuit 13, and determines that the decoding-time part is less than 75%, 50% or 25% of the reproduction time.

In step S3, if the decoding monitor 61 has determined that the decoding-time part is 75% or more of the reproduction time, the process proceeds to step S9, in which the decoding monitor 61 uses the processed band controller 62 to control the inverse-quantization and inverse-normalization circuit 12 and the waveform-signal combining circuit 13 to execute the inverse spectral transform of only the low band.

In step S4, if the decoding monitor 61 has determined that the decoding-time part is 75% to 50%, the decoding monitor 61 uses the processed band controller 62 to control the inverse-quantization and inverse-normalization circuit 12 and the waveform-signal combining circuit 13 to execute the inverse spectral transform of the middle-low band and the inverse spectral transform of the low band in steps S8 and S9, respectively.

In step S5, if the decoding monitor 61 has determined that the decoding-time part is 50% to 25%, the decoding monitor 61 uses the processed band controller 62 to control the inverse-quantization and inverse-normalization circuit 12 and the waveform-signal combining circuit 13 to execute the inverse spectral transform of the middle-high band, the inverse spectral transform of the middle-low band, and the inverse spectral transform of the low band in steps S7 to S9, respectively.

In step S5, if the decoding monitor 61 has determined that the decoding-time part is less than 25% of the reproduction time, the decoding monitor 61 uses the processed band controller 62 to control the inverse-quantization and inverse-normalization-circuit 12 and the waveform-signal combining circuit 13 to execute the inverse spectral transform of the high band, the inverse spectral transform of the middle-high band, the inverse spectral transform of the middle-low band, and the inverse spectral transform of the low band in steps S6 to S9, respectively.

In each case, in step S10, the band combining filter 32 is used to execute band-combining.

The above cases have been described using the values 25%, 50% and 75% as the decoding-time part. However, the decoding-time part is not limited to these values, and values most suitable for the system may be selected so as to continue the real-time reproduction without a break.

Figure 12:
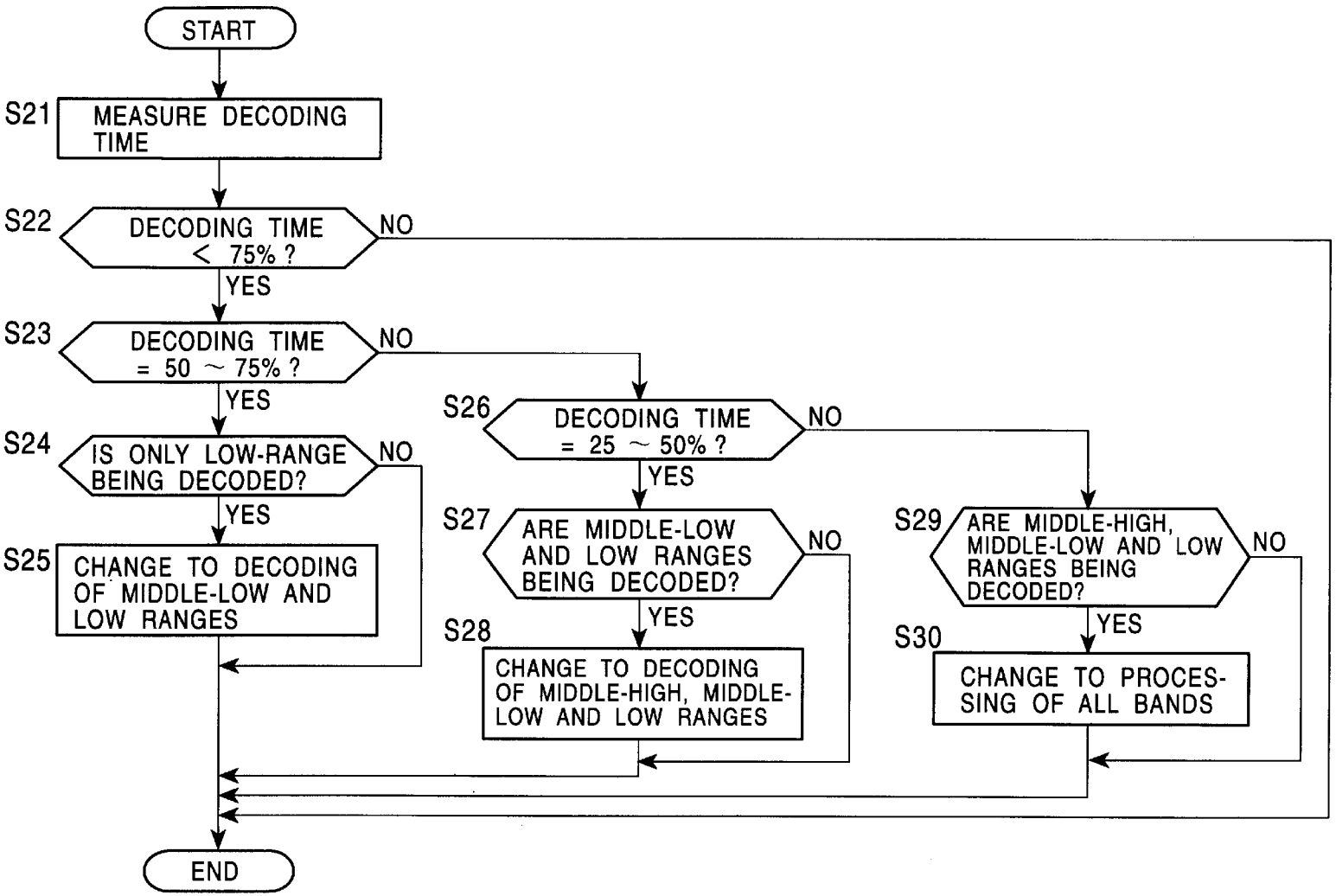
FIG. 12 is a flowchart illustrating a process for decoding according to the present invention.

In addition, after the decoding is simplified in the above steps, if the time for decoding is considerably shorter than the reproduction time of the sound signal, such as the case where some of the simultaneously executed tasks are terminated, it is possible to return from the simplified decoding to the decoding of all the bands since the decoding monitor 61 has determined that the processor can sufficiently perform decoding. The process of this case is shown in FIG. 12.

Initially, in step S21, the decoding-time part is measured. In step S22, determination of whether the decoding-time part is less than 75% of the reproduction time is performed. If the decoding-time part is 75% or more of the reproduction time, the process terminates. When the decoding-time part is less than 75% of the reproduction time, determination of whether or not the decoding-time part is 50% to 75% of the reproduction time is performed in step S23. If the decoding-time part is in this range, the process proceeds to step S24, in which it is determined whether or not only the low band is decoded. If only the low band is decoded, the process proceeds to step S25, in which the present processing is changed to the decoding of the middle-low band and the low band. If, in step S24, the decoding monitor 61 has determined that only the low band is not being decoded, step S25 is skipped.

In step S23, if the decoding monitor 61 has determined that the decoding-time part is not in the range between 50% and 75% of the reproduction time, the process proceeds to step S26, in which it is determined whether or not the decoding-time part is in the range between 25% and 50% of the reproduction time. If the decoding-time part is in the range between 25% and 50% of the reproduction time, the process proceeds to step S27, in which it is determined whether or not the middle-low band and the low band are being decoded. If these bands are being decoded, the process proceeds to step S28, in which the present decoding is changed to the decoding of the middle-high band, the middle-low band and the low band. In step S27, if the decoding monitor 61 has determined that the middle-low band and the low band are not being decoded, step S28 is skipped.

If, in step S26, the decoding monitor 61 has determined that the decoding-time part is not in the range between 25% and 50% of the reproduction time, it is concluded that the decoding-time part is less than 25% of the reproduction time. Accordingly, the process proceeds to step S29, in which it is determined whether or not the middle-high band, the middle-low band, and the low band are being decoded. If the bands are being decoded, the process proceeds to step S30, in which the present decoding is changed to the decoding of all the bands. In step S29, if the decoding monitor 61 has determined that the middle-high band, the middle-low band, and the low band are not being decoded, step S30 is skipped.

In this embodiment, only the inverse-spectral-transformed part is processed. However, the processing by band-combining filter in step S10 is also simplified.

The cases where MDCT is used as spectral transform have been used. However, needless to say, a method of the present invention can be applied also when DFT, DCT, etc. are used. In addition, the present invention may be applied to the case where decoding is performed after such special spectral transform is not used but a filter is used to divide a band.

The cases where a band to be actually processed is the low band have been described. In addition to that, it is possible to process only a band in which an actual signal level is large. However, as mentioned above, for example, a normal sound signal has important signal components distributed in its low band. Accordingly, by employing a structure for always processing only the low band, the structure, which is simplified, can produce remarkable effects.

The cases where a sound signal is encoded and decoded have been described. However, a method of the present invention is effective in processing other types of signals. Specifically, by applying the present invention to a sound signal or image signal having important information concentrated in its low band, significant effects can be obtained. In addition, a method of the present invention may be, needless to say, applied to a multichannel sound signal.

Figure 13:
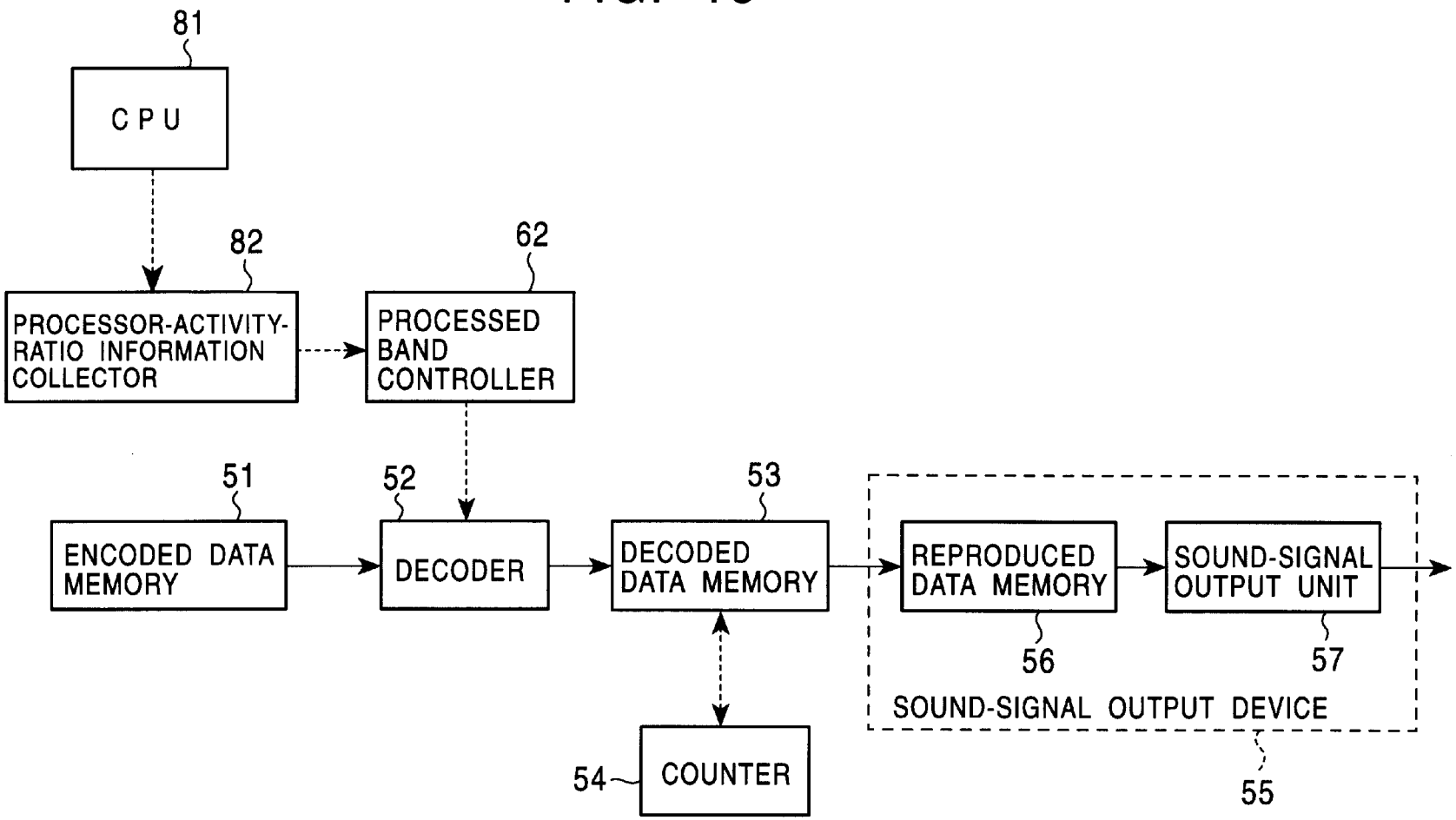
FIG. 13 is a block diagram showing a real-time reproduction system including a decoder according to another embodiment of the present invention.

In this embodiment, as described above, time needed for actual decoding is measured, and the measured value is correlated with a load on a processor, and the relationship is used as a standard of determination of whether or not decoding is simplified. However, it is possible to use a "processor load" supplied by an operating system like "Windows 95" (trademark). This is a load value on a processor, which is updated as required. By watching this load value from the program, when the value is not less than a certain value, it is determined that the processor is overloaded to hinder the sufficient continuation of real-time reproduction. The decoding may be simplified based on the determination. A block diagram used in this case is shown in FIG. 13.

A processor-load-information collector 82 receives processor-load information output from a central processing unit (CPU) 81, and controls the processed band controller 62 in accordance with the received information. In this manner, the processing condition of the decoder 52 can be indirectly watched from the output of the CPU 81 without being directly watched.

Figure 14:
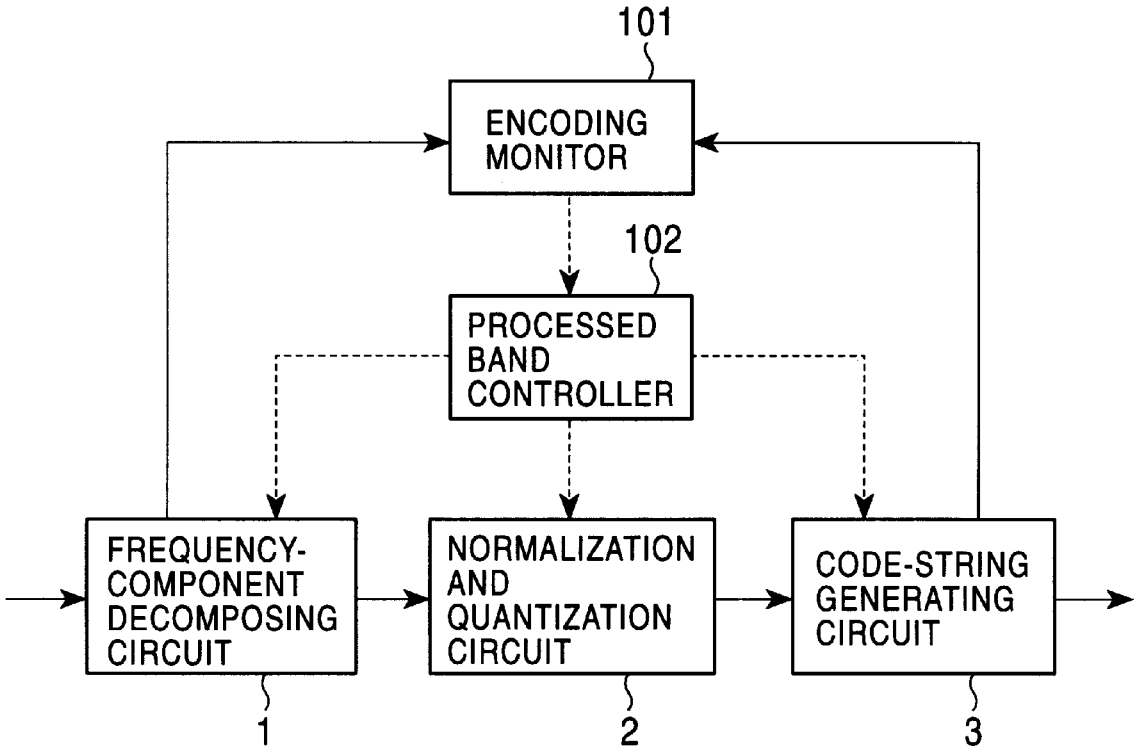
FIG. 14 is a block diagram showing a decoder according to the present invention.

Although the processing for signal decoding has been described, similar processing can be used for signal encoding. FIG. 14 shows a block diagram of this case. This block diagram corresponds to that shown in FIG. 10.

As shown in FIG. 14, an encoding monitor 101 monitors outputs from a frequency-component decomposing circuit 1 and a code-string generating circuit 3 in order to observe an encoding-time part as necessary time for encoding by the code-string generating circuit 3 in accordance with the time length (time length in reproduction) of a signal input to the frequency-component decomposing circuit 1. In accordance with the encoding-time part, the encoding monitor 101 controls a processed band controller 102 to control the frequency-component decomposing circuit 1, a normalization and quantization circuit 2 and the code-string generating circuit 3.

For example, when the encoding-time part is sufficiently small as 25% or less, the encoding monitor 101 controls all the spectral transform circuits 22-1 to 22-4 in the frequency-component decomposing circuit 1 (shown in FIG. 4) to execute spectral transform. Consequently, outputs from the frequency-component decomposing circuit 1 are as shown in FIG. 1. In other words, spectra of bands 1 to 9 are output.

The normalization and quantization circuit 2 normalizes and quantizes the outputs from the frequency-component decomposing circuit 1, and outputs them to the code-string generating circuit 3. The code-string generating circuit 3 converts the input spectral components into code strings. Consequently, the code-string generating circuit 3 outputs data as a code string for one block, as shown in FIG. 15. As shown in FIG. 15, the data includes the number of pieces of quantization-precision-information, quantization-precision information, normalization-precision information, and spectral coefficients. Since the case shown in FIG. 1 has nine divided frequency bands, there are nine pieces of quantization-precision information and nine pieces of normalization-precision information in accordance with each divided band. Accordingly, this case has nine pieces of quantization-precision information. In addition, there is a total of 64 spectral coefficients since bands 1 to 4 each have four spectral coefficients, bands 5 to 8 each have eight spectral coefficients, and band 9 has sixteen spectral coefficients.

Figure 16:
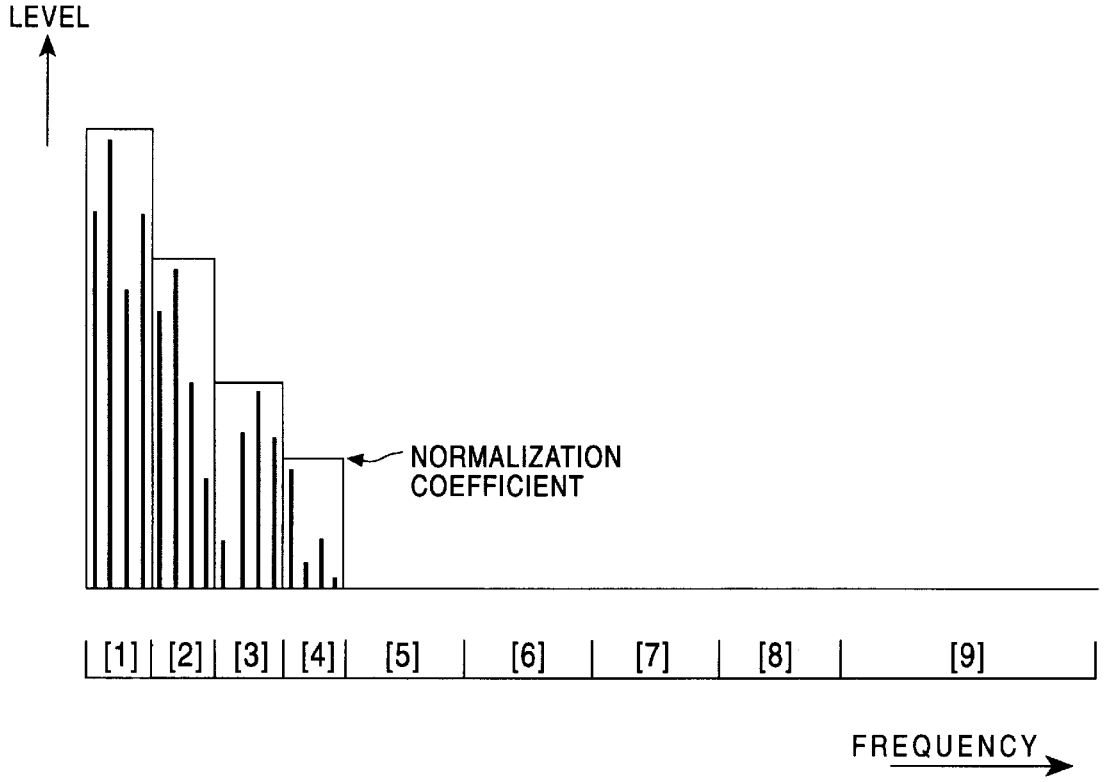
FIG. 16 is a diagram illustrating the output of the frequency-component decomposing circuit 1 shown in FIG. 14.

Conversely, when the encoding-time part is, for example, 75% or greater, the encoding monitor 101 causes only the spectral transform circuit 22-1 to operate among the spectral transform circuits 22-1 to 22-4 because time for encoding is not sufficient. Accordingly, the outputs from the frequency-component decomposing circuit 1 are as shown in FIG. 16. In other words, only the spectra of bands 1 to 4 are output.

The spectra are normalized and quantized by the normalization and quantization circuit 2, and are encoded by the code-string generating circuit 3 before they are output. Consequently, the code-string generating circuit 3 outputs data as shown in FIG. 17.

Since the case shown in FIG. 17 has four bands as shown in FIG. 16, the number of pieces of quantization-precision-information is four, and four pieces of quantization-precision information and four pieces of normalization-precision information are set. There is a total of sixteen spectral coefficients since each of bands 1 to 4 has four spectra.

Figure 18:
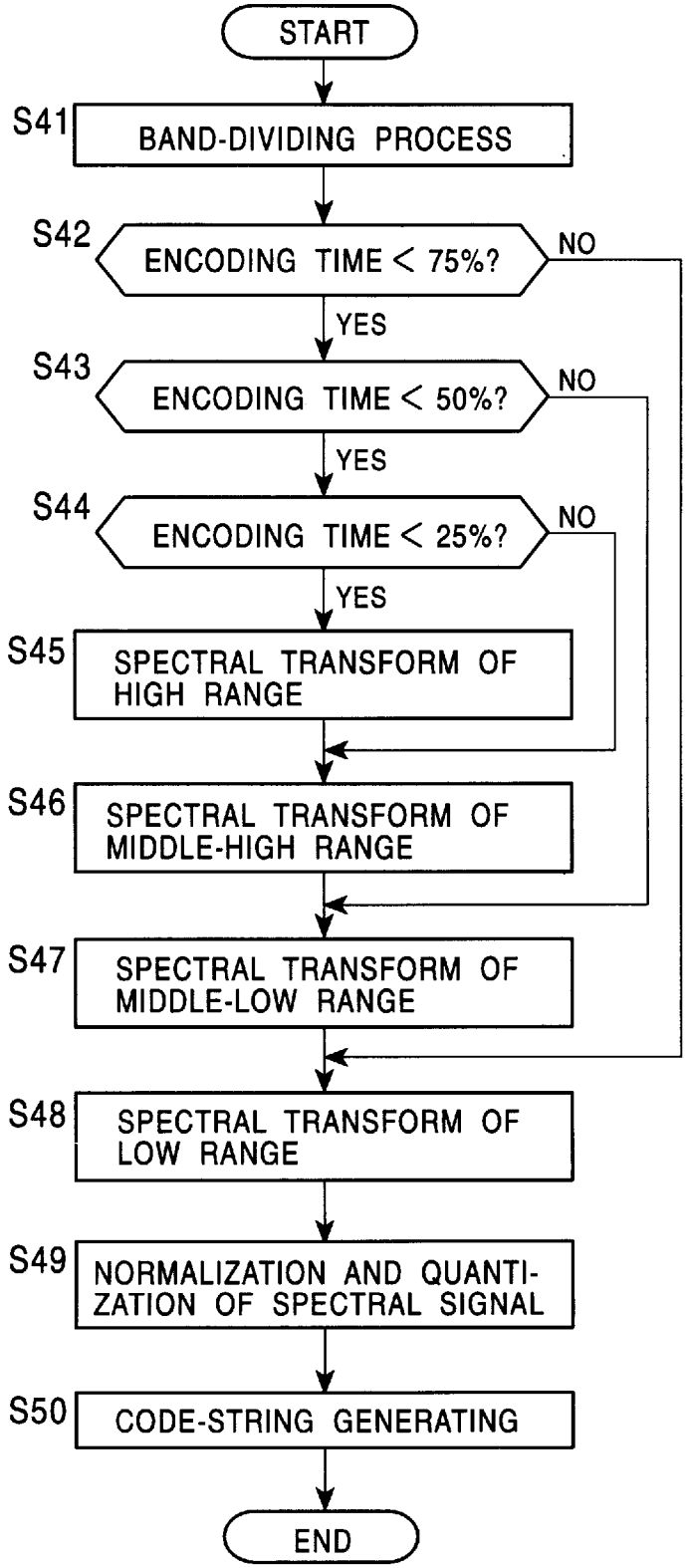
FIG. 18 is a flowchart illustrating a process for encoding according to the present invention.

FIG. 18 shows a process for performing spectral transform at four phases in accordance with an encoding-time part. This process corresponds to the above-described process for decoding shown in FIG. 11.

In the process shown in FIG. 18, initially, in step S41, the band diving filter 21 is used to divide an input signal into four signals: a low-band signal, a middle-low-band signal, a middle-high-band signal and a high-band signal. Next, in steps S42 to S44, the encoding monitor 101 determines that the encoding-time part is not less than 75%, 75% to 50%, 50% to 25% or not more than 25% of the reproduction time.

In step S42, if the encoding monitor 101 has determined that the encoding-time part is not less than 75% of the reproduction time, the process proceeds to step S48, in which the encoding monitor 101 uses the processed controller 102 to control the spectral transform circuits 22-1 to 22-4 in the frequency-component decomposing circuit 1 so that only the spectral transform circuit 22-1 execute spectral transform.

In step S42, if the encoding monitor 101 has determined that the encoding-time part is in the range between 75% and 50% of the reproduction time, in steps S47 and S48, the encoding monitor 101 uses the processed band controller 102 to control the spectral transform circuits 22-1 to 22-4 in the frequency-component decomposing circuit 1 so that only the spectral transform circuits 22-1 and 22-2 operate. In other words, only the spectral transform of the low band and the spectral transform of the middle-low band are executed.

In step S44, if the encoding monitor 101 has determined that the encoding-time part is in the range between 50% and 25% of the reproduction time, in steps S46 to S48, among the spectral transform circuits 22-1 to 22-4, the spectral transform circuits 22-1 to 22-3 are controlled to operate. The spectral transform of the low band, the spectral transform of the middle-low band, and the spectral transform of the middle-high band are executed.

In step S44, if the encoding monitor 101 has determined that the encoding-time part is not more than 25% of the reproduction time, in steps S45 to S48, all the spectral transform circuits 22-1 to 22-4 are controlled to operate. The spectral transform of the low band, the spectral transform of the middle-low band, the spectral transform of the middle-high band, and the spectral transform of the low band are executed.

In each case, the spectral-transformed signals are normalized and quantized by the normalizing and quantizing circuit 2 in step S49, and are encoded by the code-string generating circuit 3 to generate code strings in step S50.

Figure 19:
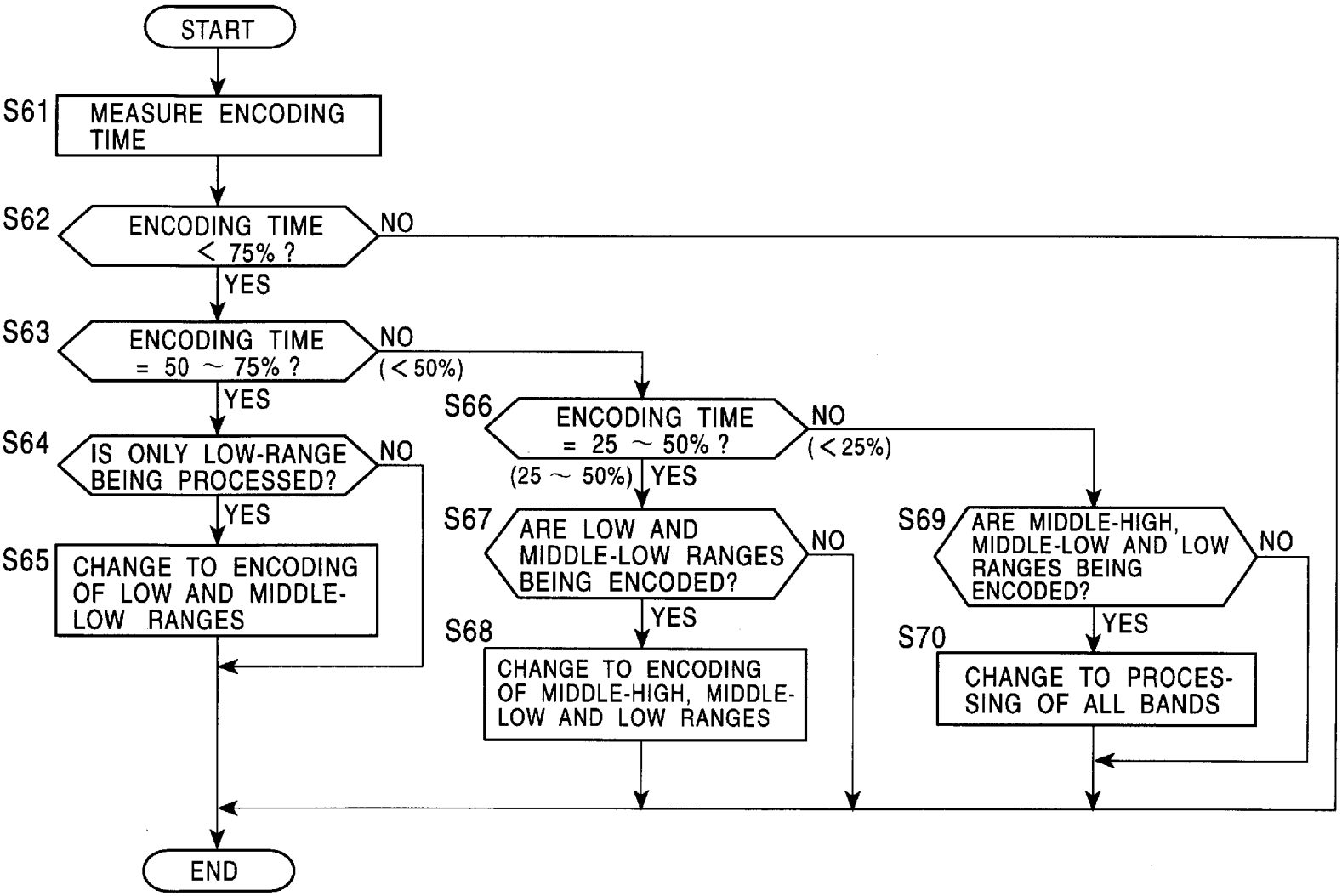
FIG. 19 is a flowchart illustrating another process for encoding according to the present invention.

In the case where the processing of the band diving filter 21 is controlled in accordance with the encoding-time part in the above manner, when the encoding-time part changes, the present encoding-time part can be returned to the encoding (spectral transform) corresponding to the changed encoding-time part. An example of this process is shown in FIG. 19. The processing example shown in FIG. 19 corresponds to the process for decoding shown in FIG. 12.

According to the processing example shown in FIG. 19, initially, in step S61, the encoding monitor 101 measures the encoding-time part. In step S62, the encoding monitor 101 determines whether or not the encoding-time part is not more than 75% of the reproduction time. If the encoding-time part is not less than 75%, no particular processing is performed (nothing changes in encoding).

In step S62, if the encoding monitor 101 has determined that the encoding-time part is not more than 75% of the reproduction time, the process proceeds to step S63, in which the encoding monitor 101 determines whether or not the value is in the range between 75% and 50%. If the encoding monitor 101 has determined that the encoding-time part is in the range between 75% and 50%, the process proceeds to step S74, in which the encoding monitor 101 determines whether or not only the low band is being processed by the frequency-component decomposing circuit 1. In other words, the encoding monitor 101 determines whether or not only the spectral transform circuit 22-1 is operating. If only the low band is being encoded, the process proceeds to step S65, the encoding monitor 101 uses the processed controller 102 to control the frequency-component decomposing circuit 1 so that the spectral transform circuits 22-1 and 22-2 operate to execute the encoding of the low band and the encoding of the middle-low band.

In step S64, if the encoding monitor 101 has determined that only the low band is not being encoded, step S65 is skipped.

In step S63, if the encoding monitor 101 has determined that the encoding-time part is not in the range between 75% and 50% of the reproduction time, in other words, that the encoding-time part is not more than 50%, the process proceeds to step S66, in which the encoding monitor 101 determines whether or not the encoding-time part is in the range between 50% and 25% of the reproduction time. If the encoding-time part is in the range between 50% and 25%, the process proceeds to step S67, in which the encoding monitor 101 determines whether or not the low band and the middle-low band are being encoded. If the low band and the middle-low band are being encoded, the process proceeds to step S68, the encoding monitor 101 uses the processed band controller 102 to control the frequency-component decomposing circuit 1 so that the spectral transform circuit 22-3 also operate in addition to the spectral transform circuits 22-1 and 22-2. In addition to the encoding of the low band and the middle-low band, the encoding of the middle-high band is executed.

In step S67, if the encoding monitor 101 has determined that only the low band and the middle-low band are not being encoded, step S68 is skipped.

In step S66, if the encoding monitor 101 has determined that the encoding-time part is not in the range between 50% and 25% of the reproduction time, in other words, the encoding-time part is not more than 25%, the process proceeds to step S69, in which the encoding monitor 101 determines whether or not only the middle-high band, the middle-low band, and the low band are being encoded. If only the middle-high band, the middle-low band, and the low band are being encoded, the process proceeds to step S70, in which the encoding monitor 101 uses the processed band controller 102 to control the frequency-component decomposing circuit 1 so that the spectral transform circuit 22-4 also operate in addition to the spectral transform circuits 22-1 to 22-3. This executes not only the spectral transform of the low band, the middle-low band and the middle-high band but also the spectral transform of the high band.

In step S69, if the encoding monitor 101 has determined that only the middle-high band, the middle-low band, and the low band are not being encoded, step S70 is skipped.

Figure 20:
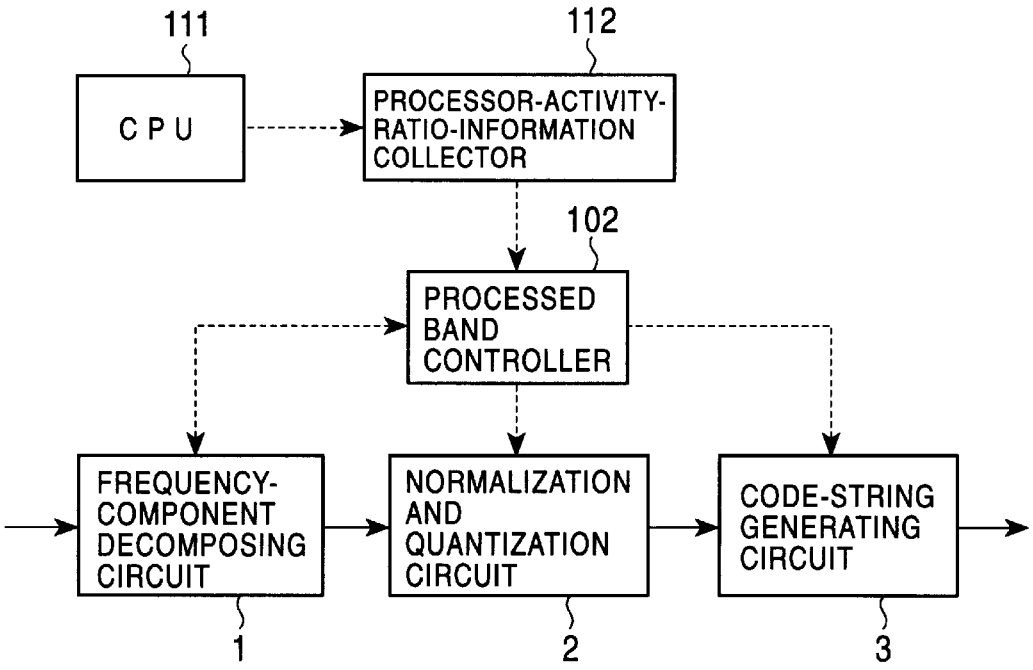
FIG. 20 is a block diagram showing a real-time encoding system according to an embodiment of the present invention.

As described above, by monitoring the frequency-component decomposing circuit 1 and the code-string generating circuit 3, the condition of encoding is detected. However, the load of a central processing unit (CPU) that manages encoding may be used to perform determination for the detection. FIG. 20 shows a process for this case. The block diagram shown in FIG. 20 corresponds to that for decoding shown in FIG. 13.

In the block diagram shown in FIG. 20, if a CPU 111 that manages encoding uses Windows 95/NT as its operating system, it outputs a "processor load". Accordingly, by obtaining this information with a processor-load-information collector 112, and controlling a processed band controller 102 in accordance with the obtained information, processing similar to the above-described case can be executed.

Figure 21:
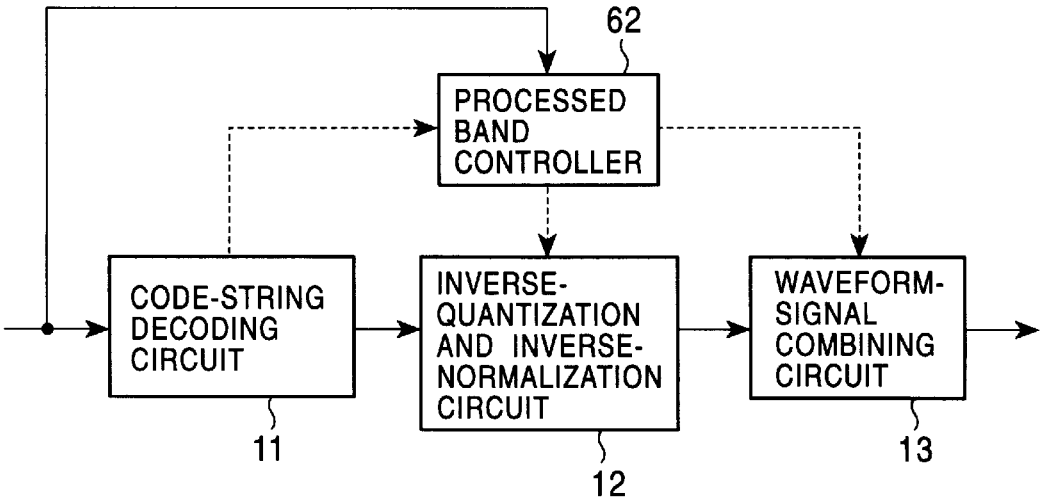
FIG. 21 is a block diagram showing another decoder according to the present invention.

In the case where the encoding side is designed to output the number of pieces of quantization-precision-information as shown in FIG. 15 or 17, the decoding side can be formed as shown in FIG. 21 such that the processed band controller 62 obtains the number of pieces of quantization-precision-information, and it controls the code-string decoding circuit 11, the inverse-quantization and inverse-normalization circuit 12 and the waveform-signal combining circuit 13 in accordance with the obtained result. In other words, concerning the embodiment shown in FIGS. 9 or 10, the decoding side independently controls a band to be decoded. However, in the embodiment shown in FIG. 21, control of a decoded band in accordance with encoding-side information (the number of pieces of quantization-precision-information).

Figure 22:
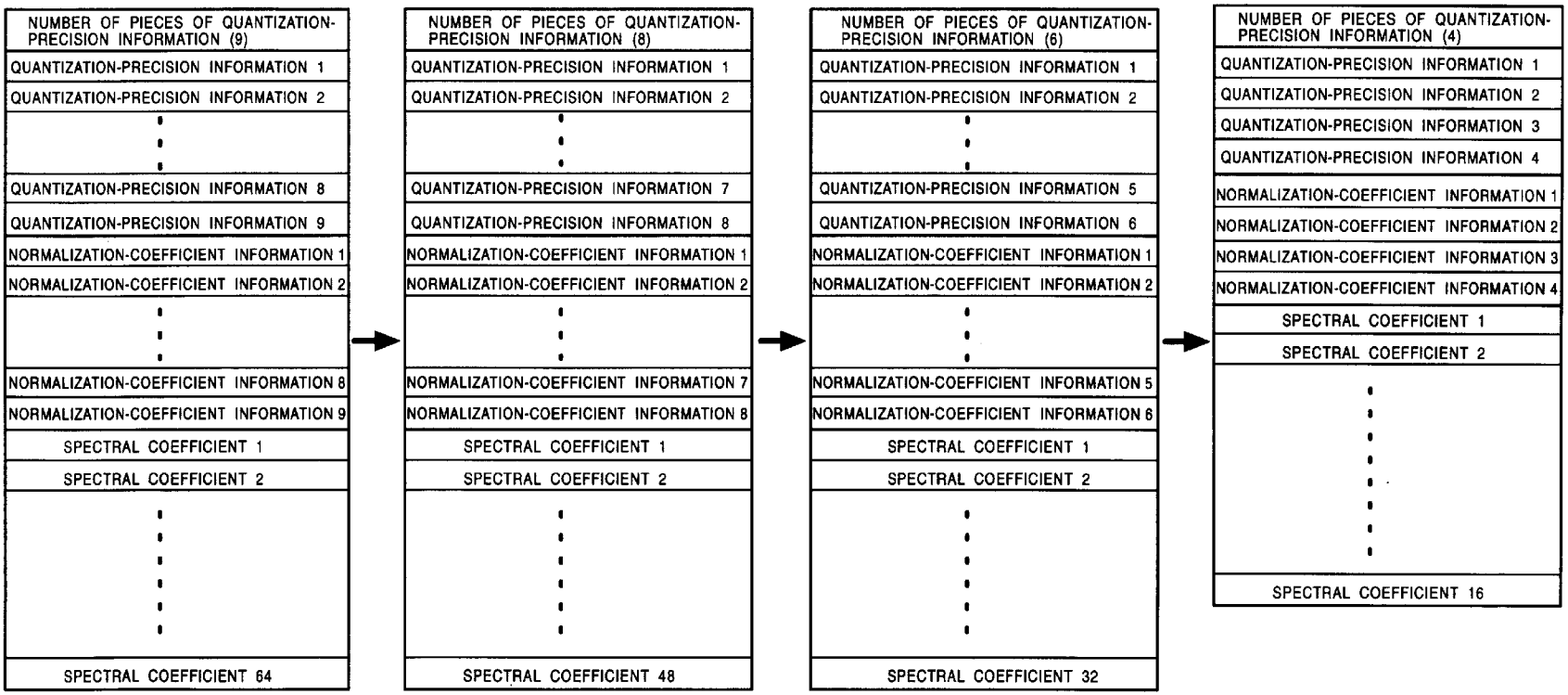
FIG. 22 is a chart illustrating changes in the number of pieces of quantization-precision-information.
Figure 23:
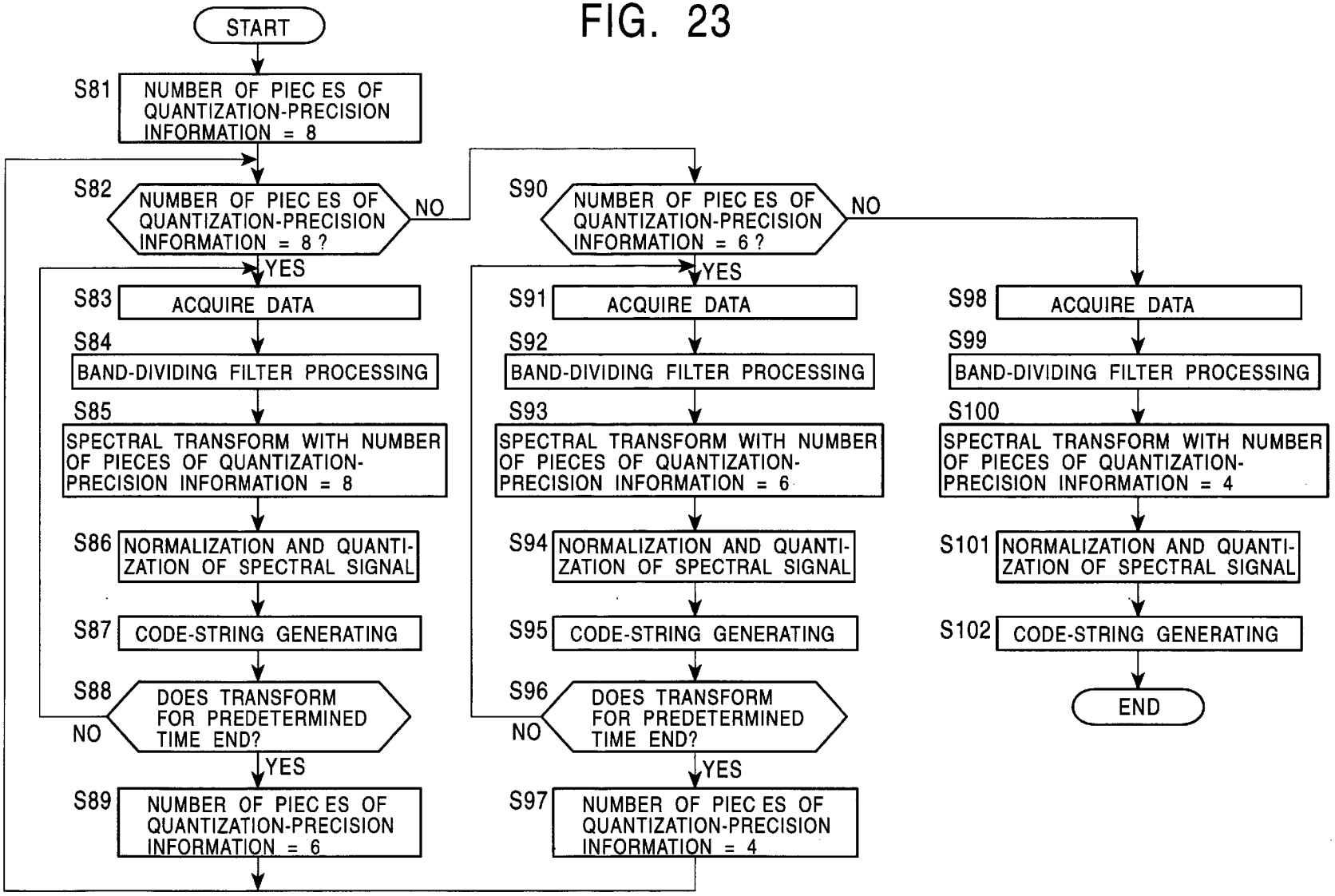
FIG. 23 is a flowchart illustrating a process for changing an encoded band, according to the present invention.

In addition, as shown in FIG. 19, when the encoding-time part is measured and a band to be encoded is changed in accordance with the measured result, data output from the code-string generating circuit 3 change in such a manner that the number of pieces of quantization-precision-information changes from value 9 (all band encoding) to value 4 (low-band encoding) through value 8 (encoding of the middle-high band or less) and value 6 (low-band encoding), as shown in FIG. 22. If this change is extremely rapid, a listener listening it may sound unpleasant to a listener listening to sound generated by decoding the code strings sound generated by decoding the code strings feels unpleasant. Accordingly, by continuing the transform of each band for at least a predetermined time, the number of pieces of quantization-precision-information can be gradually changed from 9 to 4. FIG. 23 shows a process for changing the number of pieces of quantization-precision-information from 9 to 4.

In this process shown in FIG. 23, the initial number of pieces of quantization-precision-information is 9. Therefore, in step S81, the encoding monitor 101 sets 8 as the number of pieces of quantization-precision-information. The process proceeds to step S82, in which determination of whether or not the present number of pieces of quantization-precision-information is 8 is performed. Since the present number of pieces of quantization-precision-information is 8, the process proceeds to step S83, in which data are acquired. In step S84, band-dividing filter processing is performed, and in step S85, spectral transform is performed. In other words, the encoding monitor 101 uses the processed band controller 102 to control the band dividing filter 21 in the frequency-component decomposing circuit 1 to acquire data, whereby, among the spectral transform circuits 22-1 to 22-4 operated (when the number of pieces of quantization-precision-information=9), the operation of the spectral transform circuit 22-4 is discontinued and only the spectral transform circuits 22-1 to 22-3 are controlled to operate.

Next, the process proceeds to step S85, in which the signals spectral-transformed in step S85 are normalized and quantized. The normalizing and quantizing circuit 2 normalizes and quantizes the middle-high-band, middle-low-band and low-band spectral signals.

The process proceeds to step S87, in which code strings are generated. In other words, the code-string generating circuit 3 encodes the data output from the normalizing and quantizing circuit 2 to generate code strings.

In step S88, the encoding monitor 101 determines whether or not data having a predetermined time length (as reproduction time) have been transformed. If the encoding monitor 101 has determined that the data having a predetermined time length have not been transformed, the process proceeds to step S83, in which the subsequent processing is repeatedly executed. In step S88, if the encoding monitor 101 has determined that the data having a predetermined time length have been transformed, the process proceeds to step S89, in which the encoding monitor 101 sets 6 as the number of pieces of quantization-precision-information.

Next, the process returns to step S82, in which determination of whether or not the present number of pieces of quantization-precision-information is 8 is performed. Since, in this case, the number of pieces of quantization-precision-information is 6, not 8, the process proceeds to step S90, in which determination of whether or not the number of pieces of quantization-precision-information is 6 is performed. In this case, the number of pieces of quantization-precision-information is 6. The process proceeds to step S91, in which data acquiring is executed, and in step S92, band-dividing-filter processing is executed. In step S93, spectral transform is executed using 6 as the number of pieces of quantization-precision-information.

In other words, the encoding monitor 101 uses the processed band controller 102 to discontinue the operation of the spectral transform circuit 22-3 among the spectral transform circuits 22-1 to 22-3, which have operated, and to continue only the operation of the spectral transform circuit 22-2.

In step S94, the normalizing and quantizing circuit 2 normalizes and quantizes the spectral signals output from the frequency-component decomposing circuit 1. In step S95, the code-string generating circuit 3 executes code-string generating.

The process proceeds to step S96, in which it is determined whether or not data having a predetermined time length have been transformed using the number of pieces of quantization-precision-information=6. If the data having a predetermined time length have not been transformed, the process returns to step S91, in which the subsequent processing is repeatedly performed. In step S96, if the data having a predetermined time length have been transformed, the process proceeds to step S97, in which the encoding monitor 101 sets 4 as the number of pieces of quantization-precision-information.

The process proceeds to step S82, in which it is determined whether or not the present number of pieces of quantization-precision-information is 8. In this case, the number of pieces of quantization-precision-information is 4. Accordingly, in step S82, the result of determination is NO, and in step S90, the result of determination is NO. The process proceeds to step S98, in which data acquiring is executed, and in step S99, band-dividing-filter processing is executed. In step S100, spectral transform is executed using 4 as the number of pieces of quantization-precision-information.

In other words, at this time, the encoding monitor 101 uses the processed band controller 102 to control the frequency-component decomposing circuit 1 so that, among the spectral transform circuits 22-1 and 22-2 having operated, the operation of the spectral transform circuit 22-2 is discontinued and only the spectral transform circuit 22-1 operates.

In step S101, the normalizing and quantizing circuit 2 normalizes and quantizes the spectral signals output from the frequency-component decomposing circuit 1. In step S102, the code-string generating circuit 3 executes code-string generating.

As described above, in the process between the number of pieces of quantization-precision-information=9 and the number of pieces of quantization-precision-information=4, transform processing using the number of pieces of quantization-precision-information=8 or 6 is successively performed within predetermined time. Thus, by setting the time to an appropriate value, unpleasantness to the listener, occurring in the process, can be suppressed.

In FIG. 23, the case where the number of pieces of quantization-precision-information gradually decreases has been described. Conversely, similar processing may be executed for the case where the number of pieces of quantization-precision-information gradually increases.

Figure 24:
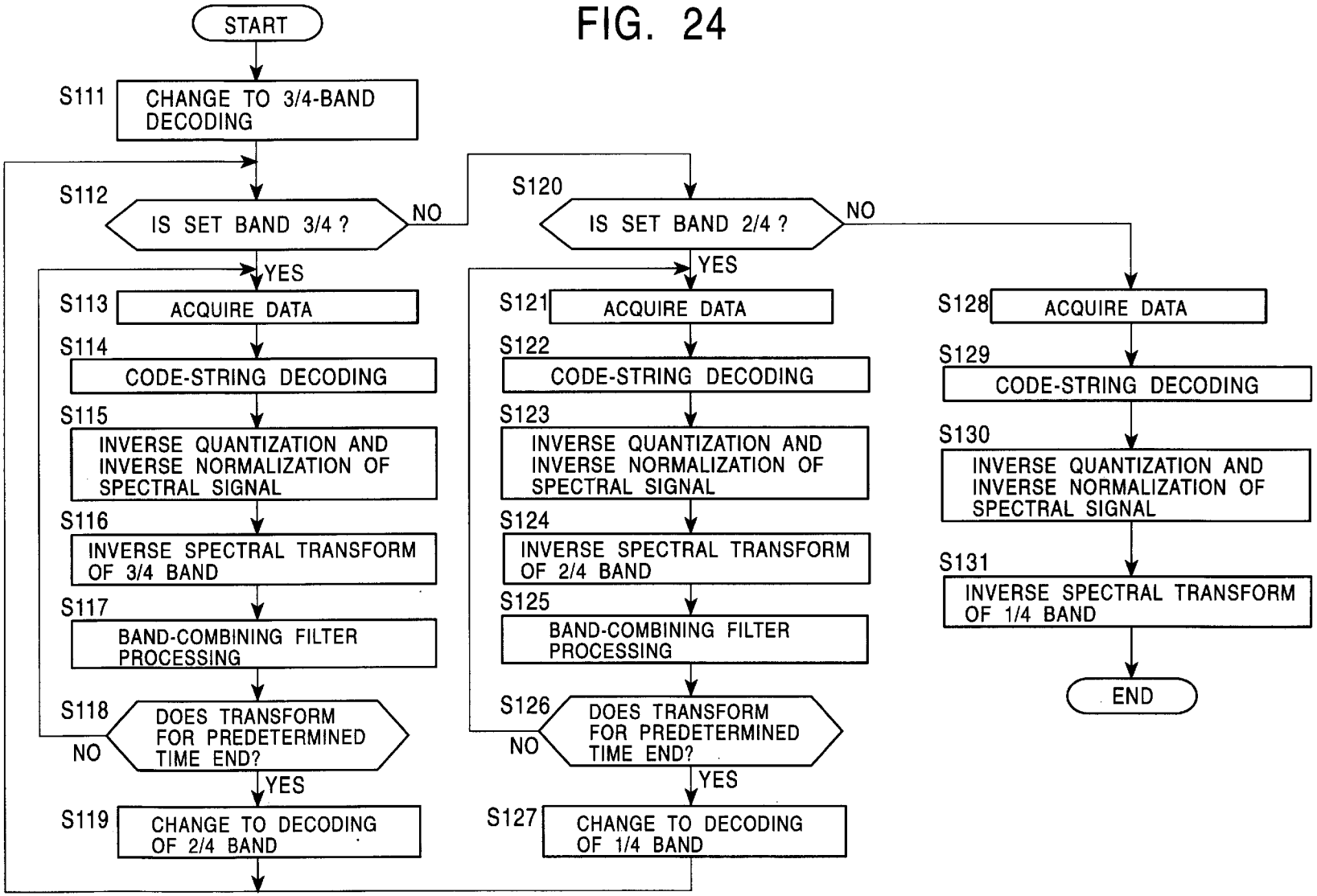
FIG. 24 is a flowchart illustrating a process for changing a decoded band, according to the present invention.

In FIG. 23, the processing by the encoding side has been described. In addition, similar processing may be executed on the decoding side. This case is illustrated by the flowchart shown in FIG. 24.

In step S111, initially, 4/4-band decoding in which all the inverse spectral transform circuits 31-1 to 31-4 in the waveform-signal combining circuit 13 shown in FIG. 5 operate is executed. Accordingly, the decoding monitor 61 changes it to 3/4-band decoding. In step S112, it is determined whether or not the 3/4-band decoding is presently set. Since the 3/4-band decoding is presently set in this case, the process proceeds to step S113, in which data acquiring is executed, and in step S114, code-string decoding is executed.

In other words, the decoding monitor 61 uses the processed band controller 62 to control the code-string decoding circuit 11 so that the input data are acquired and decoded.

The process proceeds to step S115, in which the inverse quantization and inverse normalization of spectral signals is executed. In other words, the inverse-quantization and inverse-normalization circuit 12 executes the inverse quantization and inverse normalization of spectral signals output from the code-string decoding circuit 11. In step S116, the waveform-signal combining circuit 13 executes 3/4-band inverse spectral transform. In other words, the decoding monitor 61 uses the processed controller 62 to control the waveform-signal combining circuit 13 so that, among the inverse spectral transform circuits 31-1 to 31-4, which have operated (when 4/4-band decoding is set), the operation of the inverse spectral transform circuit 31-4 is discontinued and only the inverse spectral transform circuits 31-1 to 31-3 operate.

In step S117, the band-combining filter 32 executes band-combining-filter processing. In other words, the band-combining filter 32 combines signals supplied from the inverse spectral transform circuits 31-1 to 31-3, and output the combined signal.

In step S118, a determination is made of whether or not the predetermined transform for a predetermined time length ends. If the transform does not end, the process returns to step S113, in which the subsequent processing is repeatedly executed. In step S118, if the transform ends, the process proceeds to step S119, in which the decoding monitor 61 sets 2/4-band decoding.

In step S112, it is determined whether or not 3/4-band decoding is presently set. In the present case, 2/4-band decoding is set. The process proceeds to step S120. In step S120, it is determined whether or not 2/4-band decoding is presently set. In the present case, 2/4-band decoding is presently set. Accordingly, the process proceeds to step S121, in which data acquiring is executed, and in step S122, code-string decoding is executed. In step S123, the inverse quantization and inverse normalization is executed, and in step S124, 2/4-band inverse spectral transform is executed. In step S125, band-combining-filter processing is executed.

In other words, the decoding monitor 61 uses the processed band controller 62 to control the waveform-signal combining circuit 13 so that, among the inverse spectral transform circuits 31-1 to 31-3 having operated (when ¾-band decoding is set), the operation of the inverse spectral transform circuit 31-3 is discontinued and only the inverse spectral transform circuits 31-1 and 31-2 operate. Only low-band inverse spectral transform and middle-low-band inverse spectral transform are executed. The band-combining filter 32 combines the low-band and middle-low-band signal components, and outputs the combined component.

In step S126, it is determined whether or not decoding for a predetermined time length. If the decoding for a predetermined time length does not end, the process turns to step S121, in which the subsequent processing is repeatedly performed. In step S126, if the decoding for a predetermined time length ends, the process proceeds to step S127, in which the decoding monitor 61 sets ¼-band decoding.

The process proceeds back to step S112, in which determination of whether or not ¾-band decoding is present set is performed. In the present case, ¼-band decoding is set. Accordingly, the result of the determination is NO, and in step S120, the result of determination is NO. The process proceeds to step S128, in which data acquiring is executed. In step S129, code-string decoding is executed, and in step S130, the inverse spectral transform and inverse normalization of spectral signals is executed. In step S131, ¼-band inverse spectral transform is executed.

In other words, the decoding monitor 61 uses the processed band controller 62 to control the waveform-signal combining circuit 13 so that, among the inverse spectral transform circuits 31-1 and 31-2 having operated (when ¾-band decoding is set), the operation of the inverse spectral transform circuit 31-2 is discontinued and only the inverse spectral transform circuit 31-1 operates. Consequently, only low-band inverse spectral transform is executed.

As described above, in the process between the ¾-band decoding and the ¼-band decoding, the intermediate ¾-band and ¾-band transform processing is successively performed by a predetermined time. Thus, unpleasantness for the listener, occurring in the process, can be suppressed.

The above-described processing can be applied to not only the case where a decoded band is gradually narrowed but also the case where a decoded band is gradually extended.

In the foregoing embodiments, a load on a processor is monitored, and encoding and decoding is simplified in accordance with the magnitude of the load. However, the present invention is not limited to the foregoing embodiments. For example, there may be a case in which, when encoding or decoding is performed in a battery-operated unit, a decrease in the power of a battery activates a low-power-adapted mode to simplify the operation of a processor. In this case, real-time reproduction might be impossible due to a decrease in the operation-processing ability of the processor. Accordingly, it is possible to switch processing for simplifying encoding or decoding when the remaining power of the battery decreases to hinder real-time reproduction as a result of monitoring the remaining power of the battery.

Transmission media, used for transmitting a program for executing the above-described processing, include not only information recording media such as a compact-disc read-only memory, but also networks such as the Internet and digital broadcasting links.

What is claimed is:

1. A signal processing apparatus comprising:

decoding means for decoding codes representative of encoded frequency components, to obtain, as a result, frequency components;

combining means for combining the frequency components obtained by said decoding means to form a waveform signal;

monitor means for monitoring a processing condition of said decoding means; and control means for controlling a number of processed bands of the waveform signal formed by said combining means in accordance with a monitoring result of said monitor means.

2. A signal processing apparatus according to claim 1, wherein, when the decoding by said decoding means is delayed from a reference, said control means implements control for omitting the processing of a high band of the waveform signal.

3. A signal processing apparatus according to claim 1, wherein, when the combining by said combining means is delayed from a reference, said control means implements control for omitting the processing of a high band of the waveform signal.

4. A signal processing apparatus according to claim 1, wherein said control means implements control for changing the number of processed bands of the waveform signal in a plurality of stages in accordance with the monitoring result of said monitor means.

5. A signal processing apparatus according to claim 4, wherein, when said control means changes the number of processed bands from a first stage to a second stage in accordance with the monitoring result of said monitor means, said control means implements control for executing the processing between the first and second stages within at least a predetermined duration.

6. A signal processing apparatus according to claim 1, wherein said combining means comprises inverse-spectral-transform means for implementing the inverse spectral transform of an input signal, and band-combining means for combining outputs from said inverse-spectral-transform means.

7. A signal processing apparatus according to claim 1, wherein said monitor means monitors the time necessary for decoding a predetermined amount of input codes.

8. A signal processing apparatus according to claim 1, further comprising a processor for controlling various operations, wherein said monitor means monitors the load of said processor.

9. A signal processing method comprising the steps of:

decoding codes representative of encoded frequency components, to obtain, as a result, frequency components;

combining the frequency components obtained in the decoding step to form a waveform signal;

monitoring a processing condition in the decoding step; and controlling a number of processed bands of the waveform signal, formed in the combining step, in accordance with a monitoring result obtained in the monitoring step.

10. A signal processing method according to claim 9, wherein, when the decoding in the decoding step is delayed from a reference, the controlling step implements control for omitting the processing of a high band of the waveform signal.

11. A signal processing method according to claim 9, wherein, when the combining by the combining step is delayed from a reference, the controlling step implements control for omitting a processing of the high band of the waveform signal.

12. A signal processing method according to claim 9, wherein the controlling step implements control for changing the number of processed bands of the waveform signal in a plurality of stages in accordance with the monitoring result of the monitoring step.

13. A signal processing method according to claim 12, wherein, when the controlling step changes the number of processed bands from a first stage to a second stage in accordance with the monitoring result of the monitoring step, the controlling step implements control for executing the processing between the first and second stages within at least a predetermined duration.

14. A signal processing method according to claim 9, wherein the combining step comprises the steps of implementing the inverse spectral transform of an input signal, and combining outputs from the inverse-spectral-transform step.

15. A signal processing method according to claim 9, wherein the monitoring step monitors the time necessary for decoding a predetermined amount of input codes.

16. A signal processing method according to claim 9, wherein the monitoring step monitors the load of a processor for controlling various operations.

17. A signal processing apparatus comprising:

decomposing means for decomposing an input signal into frequency-component signals;

encoding means for encoding the frequency-component signals decomposed by said decomposing means;

monitor means for monitoring a processing condition of said decomposing means; and control means for controlling a number of processed bands of the frequency component signals formed by said decomposing means in accordance with a monitoring result of said monitor means.

18. A signal processing apparatus according to claim 17, wherein, when the decomposing by said decomposing means is delayed from a reference, said control means implements control for omitting the processing of a high band of the waveform signal.

19. A signal processing apparatus according to claim 17, wherein, when the decomposing by said decomposing means is delayed from a reference, said control means implements control for omitting the processing of a high band of the waveform signal.

20. A signal processing apparatus according to claim 17, wherein said control means implements control for changing the number of processed bands of the waveform signal in a plurality of stages in accordance with the monitoring result of said monitor means.

21. A signal processing apparatus according to claim 20, wherein, when said control means changes the number of processed bands from a first stage to a second stage in accordance with the monitoring result of said monitor means, said control means implements control for executing the processing between the first and second stages within at least a predetermined duration.

22. A signal processing apparatus according to claim 17, wherein said decomposing means comprises means for dividing the input signal into signals corresponding to frequency bands, and transform means for implementing a spectral transform of the divided frequency-band signals.

23. A signal processing apparatus according to claim 17, wherein said monitor means monitors the time necessary for encoding a predetermined amount of input codes.

24. A signal processing apparatus according to claim 17, further comprising a processor for controlling various operations, wherein said monitor means monitors the load of the processor.

25. A signal processing method comprising the steps of:

decomposing an input signal into frequency-component signals;

encoding the frequency-component signals formed by the decomposing step;

monitoring a processing condition of the encoding step; and controlling a number of processed bands of the frequency component signals formed by the decomposing step in accordance with a monitoring result of the monitoring step.

26. A signal processing method according to claim 25, wherein, when a processing by the encoding step is delayed from a reference, the controlling step implements control for omitting the processing of a high band of the waveform signal.

27. A signal processing method according to claim 25, wherein, when a processing by the decomposing step is delayed from a reference, the controlling step implements control for omitting the processing of a high band of the waveform signal.

28. A signal processing method according to claim 25, wherein the controlling step implements control for changing the number of processed bands of the waveform signal in a plurality of stages in accordance with the monitoring result of the monitoring step.

29. A signal processing method according to claim 28, wherein, when the controlling step changes the number of processed bands from a first stage to a second stage in accordance with the monitoring result of the monitoring step, the controlling step implements control for executing the processing between the first and second stages within at least a predetermined duration.

30. A signal processing method according to claim 25, wherein the decomposing step comprises the steps of dividing the input signal into signals corresponding to frequency bands, and implementing a spectral transform of the divided frequency-band signals.

31. A signal processing method according to claim 25, wherein the monitoring step monitors the time necessary for encoding a predetermined amount of input codes.

32. A signal processing method according to claim 25, wherein the monitoring step monitors the load of a processor for controlling various operations.

33. A transmission medium for transmitting a program comprising the steps of:

decoding codes representative of encoded frequency components, to obtain, as a result, frequency components;

combining the frequency components obtained in the decoding step to form a waveform signal;

monitoring a processing condition in the decoding step; and controlling a number of processed bands of the waveform signal, formed in the combining step, in accordance with a monitoring result obtained in the monitoring step.

34. A transmission medium for transmitting a program comprising the steps of:

decomposing an input signal into frequency-component signals;

encoding the frequency-component signals decomposed by the decomposing step;

monitoring a processing condition of the decomposing step; and controlling a number of processed bands of frequency component signals formed by the decomposing step in accordance with a monitoring result of the monitoring step.

35. A recording medium for holding codes generated by implementing signal processing, said processing comprising the steps of:

decomposing an input signal into frequency-component signals;

encoding the frequency-component signals formed by the decomposing step;

monitoring a processing condition of the encoding step;

controlling a number of processed bands of the frequency component signals formed by the decomposing step in accordance with a monitoring result of the monitoring step; and recording the encoded frequency-component signals on said recording medium.

* * * * *